US005368279A

United States Patent [19]

Ottemann et al.

[11] Patent Number: 5,368,279

[45] Date of Patent: Nov. 29, 1994

[54] AUTOMATIC LOAD RESPONSIVE WINCH

[75] Inventors: William Ottemann, Fallbrook, Calif.; Bruno Resch, Greystanes, Australia; Guillermo Ferramola, Ventura, Calif.

[73] Assignee: IMI Barient, Inc., Guilford, Conn.

[21] Appl. No.: 927,802

[22] Filed: Aug. 10, 1992

[51] Int. Cl.[5] ..... B66D 1/24

[52] U.S. Cl. ..... 254/342; 74/810.1; 74/337

[58] Field of Search ..... 254/342, 345, 371; 74/810.1, 337.5, 337; 192/45.1, 41 R, 54, 46

[56] References Cited

U.S. PATENT DOCUMENTS

| | | | |
|---|---|---|---|
| 3,599,937 | 8/1971 | Carter | 74/337 |
| 3,728,914 | 4/1973 | Guangorena et al. . | |
| 3,809,368 | 5/1974 | Lawrence . | |
| 3,927,580 | 12/1975 | Fawcett . | |
| 3,962,935 | 6/1976 | Hutton et al. . | |
| 3,973,755 | 8/1976 | Fawcett . | |
| 3,981,208 | 9/1976 | Moses . | |
| 4,054,266 | 10/1977 | Guangorena . | |
| 4,111,397 | 9/1978 | Bonassi | 74/810.1 |
| 4,208,036 | 6/1980 | Huggett et al. . | |
| 4,261,549 | 4/1981 | Bonassi | 74/810.1 |
| 4,582,299 | 4/1986 | Royle . | |
| 4,667,934 | 5/1987 | Ottemann . | |
| 4,699,360 | 10/1987 | van der Aa . | |
| 4,725,043 | 2/1988 | Atfield | 74/810.1 |
| 4,974,814 | 12/1990 | Cundy . | |

FOREIGN PATENT DOCUMENTS

| | | |
|---|---|---|
| 0159095 | 10/1985 | European Pat. Off. . |
| WO88/06565 | 9/1988 | WIPO . |

*Primary Examiner*—Katherine Matecki

*Attorney, Agent, or Firm*—St. Onge Steward Johnston & Reens

[57] ABSTRACT

An automatic load responsive winch is disclosed and includes a base, a winch drum rotatable mounted on the base, and a rotatable drive shaft for driving the winch drum. At least two gear trains are mounted between the drive shaft and the drum for rotating the drum in response to rotation of the drive shaft. One of the two gear trains produces a different drum speed than the other gear train. In one embodiment, when a variable torque load is applied to the winch, a mechanism is vertically displaceable. The mechanism engages one of the gear trains at a first vertical position of the mechanism and disengages the one gear train at a second vertical position to isolate the one gear train and provide for rotation of the winch drum by the other gear train. In another embodiment, when a variable torque load is applied to the winch, a mechanism is angularly displaceable. The mechanism engages one of the gear trains at a first angular position of the mechanism and disengages the one gear train to isolate the one gear train and permit rotation of the winch drum by the other gear train.

19 Claims, 19 Drawing Sheets

FIG. 13
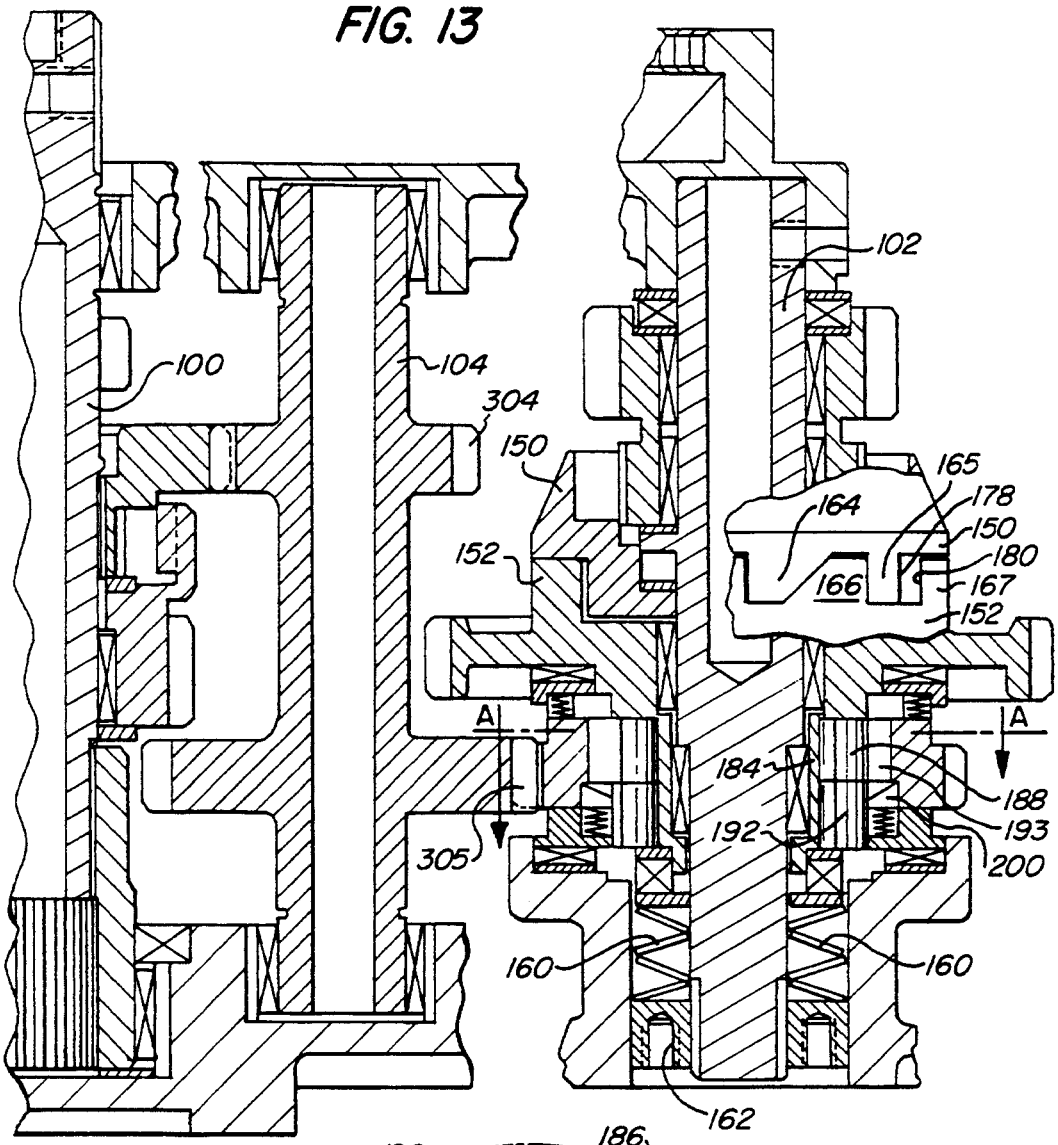
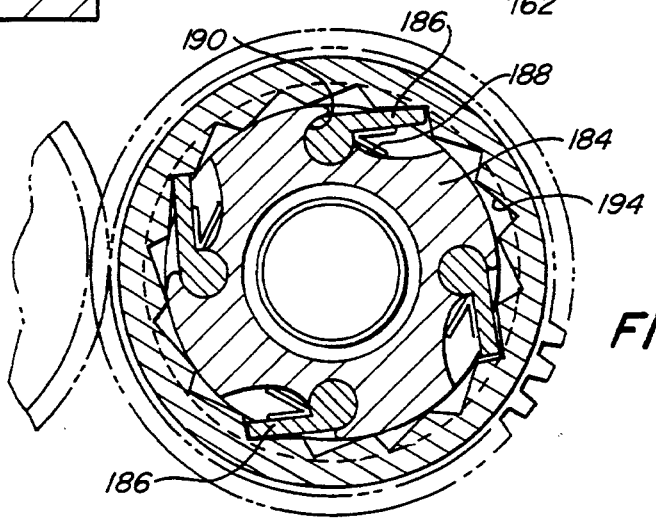
FIG. 14

FIG. 15
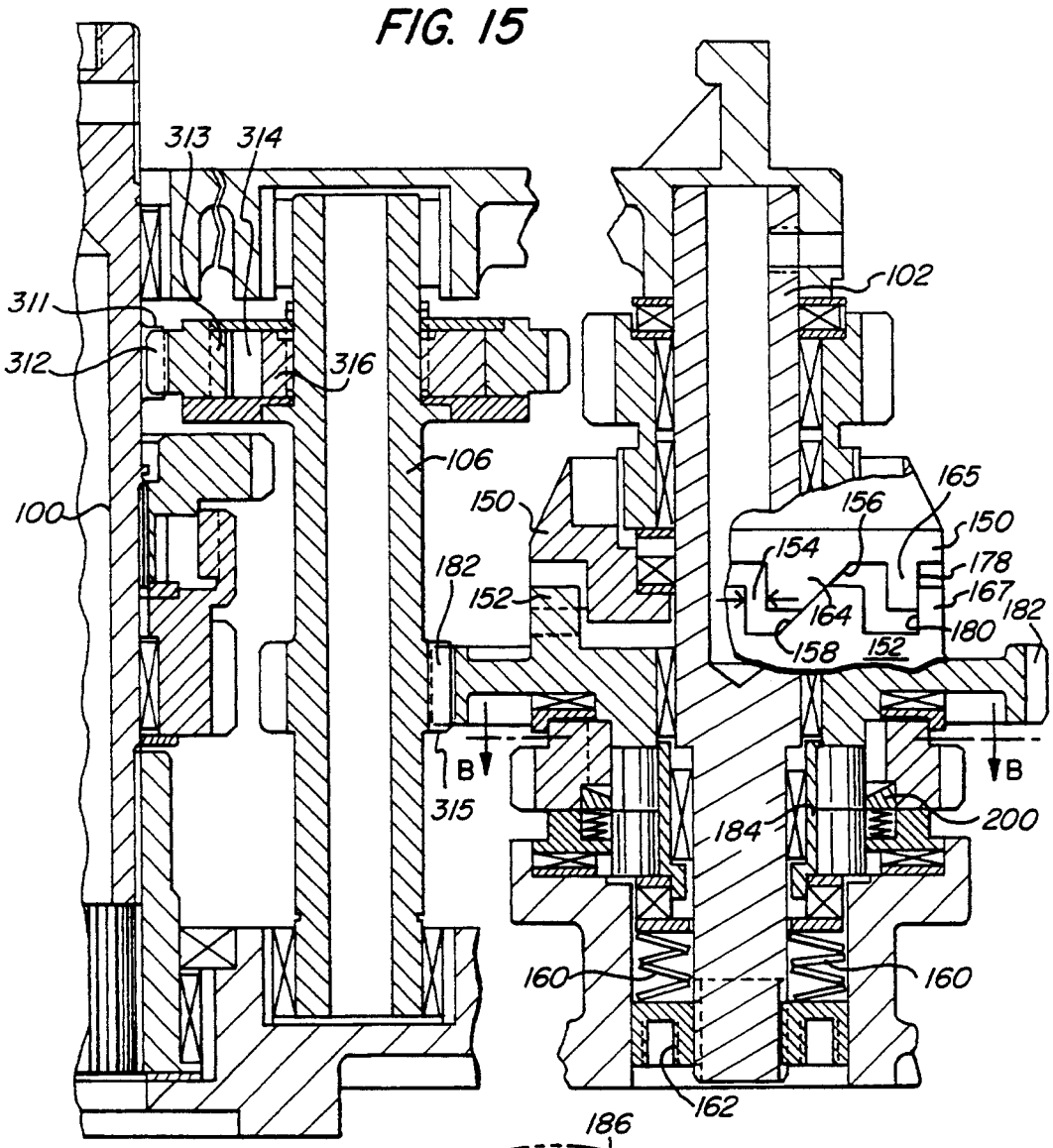
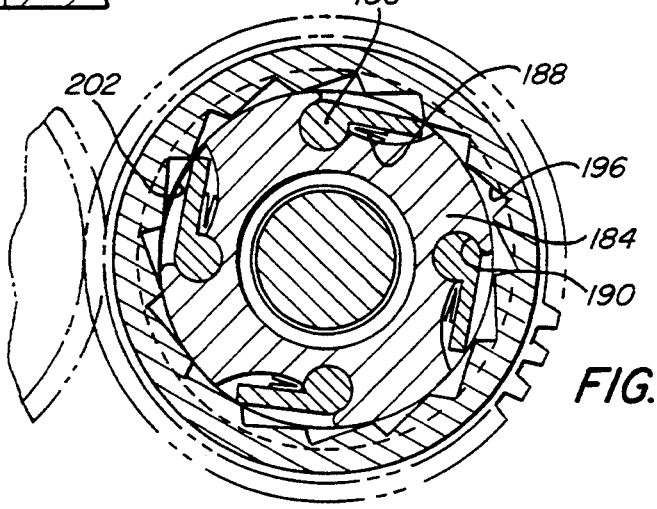
FIG. 16

AUTOMATIC LOAD RESPONSIVE WINCH

This is a continuation-in-part of copending International Application No. PCT/US91/01804 which was filed Mar. 21, 1991 and designated the United States.

This invention relates to winches and has been devised particularly though not solely for use in winches employed on marine craft such as yachts.

Such winches are known and are used extensively in yachting for tensioning sheets, halyards and other running rigging of yachts. The tensioning is effected by winding a handle which turns a winch drum through a plurality of gear trains of differing velocity ratios so that by progressively, selectively increasing the velocity ratios, a sheet, for example, can be quickly brought up to the required tension. In prior art two-speed winches, selection of the appropriate velocity ratio is effected by reversal of the direction of rotation of the operating handle. In some prior art three-speed winches, the third velocity ratio is offered by vertical movement of a handle shaft to cause a dog clutch to be engaged or disengaged from a direct drive connection to the winch drum.

In U.S. Pat. No. 4,054,266, a three-speed winch is disclosed in which a lever is operated to engage a first gear train (the gear train which is normally used first and has the lowest velocity ratio). The winch handle is rotated in one direction in first gear, then in the opposite direction to automatically engage second gear (a gear train of intermediate velocity ratio) and then the winch handle is again reversed to engage third gear (the gear train of highest velocity ratio).

In European Patent Specification Publication No. 0 159 095, a three-speed winch is disclosed in which a number of gears are provided, one set mounted on a shaft fixed to a base and other sets being mounted on a rotatable carrier which is rotatable on the base and which is spring-loaded to engage under zero or minimum load on the winch drum a first gear train out of three gear trains, the first gear train including a gear on the shaft fixed to the base. If the handle is rotated in one direction, say clockwise, in these conditions, the first gear train is operated instead of a third gear train so long as the carrier is not caused by operation of the handle in the opposite direction to move against the loading spring. Operation of the handle in the opposite direction results in engagement of the second intermediate velocity ratio gear train, and the engagement remains until the direction of rotation of handle is again reversed to the original direction. A spring-loaded pawl acts on a selected gear to prevent reverse rotation of the winch in the first speed.

This three-speed winch is not load responsive in the sense that the operable gear train is dependent on the torque load on the winch, which is generated by the sheet load. The description gives emphasis to the feature that the transition between the three-gear trains takes place fully automatically only by changing direction of rotation of the driving gear, and this winch must always start in first gear even if the initial sheet load is high so that the winch operator is required to start cranking the winch in the second gear direction in order to shift the winch out of first gear into third gear via the second gear.

International Application PCT/AU88/0053 (International Publication No. WO88/06565) describes a three-speed winch having three gear trains. Drive is transferred between two of the gear trains by displacement of a gear of one of the gear trains between an inoperative and operative position. This particular winch has the disadvantage that it is reasonably complex and, therefore, expensive to manufacture. Still further, the complexity adds to the weight of the winch. A still further disadvantage is that the winch does not lend itself for adapting to the configuration of existing winches.

It is the object of the present invention to overcome or substantially ameliorate the above disadvantages.

The invention comprises an automatic load-responsive winch which includes a base, a winch drum rotatably mounted on the base, and a rotatable drive shaft for driving the winch drum. The winch also includes at least two gear trains, each including at least one gear, and mounted between said drive shaft and said drum for rotating said drum in response to rotation of the drive shaft. One of the two gear trains produces a different drum speed than the other of the gear trains for the same rotational speed of the drive shaft.

During operation, a variable torque load is applied to the winch by operation of a line or rope wound on the winch drum. The torque load on the winch determines which gear train drives the winch drum.

In accordance with one embodiment of the invention, the gear trains are mounted on driven shafts, and the winch includes a mechanism vertically displaceable with respect to one shaft in response to changes in the variable torque load. The mechanism includes a means for engaging one of the gear trains at a first vertical position of the mechanism and for disengaging the gear train at a second vertical position to isolate the one gear train and provide for rotation of the drum by the other gear train.

In accordance with one aspect of the embodiment, the mechanism is mounted for rotation with the one shaft and includes a cylindrical opening for receiving the shaft. The opening includes a plurality of longitudinally extending splines and the shaft also has a plurality of longitudinally extending splines engaging the splines of the mechanism. The mechanism rotates in response to rotation of the shaft, but is slidable longitudinally with respect to the shaft from the first vertical position to the second vertical position. The mechanism reciprocates up and down and is spring biased to the first vertical position and slidable against said bias to the second vertical position. The shaft splines engage the mechanism splines to produce friction that increases as the torque load on the winch increases. The mechanism is maintained in the second vertical position when the friction is increased in response to the torque load to an amount sufficient to overcome the spring bias on the mechanism.

In accordance with a further aspect of the embodiment, the mechanism described in the paragraph immediately above includes a plurality of ramps protruding vertically upwardly therefrom and being spaced in an arc around the mechanism. The ramps periodically engage a plurality of ramps located in a fixed vertical position with respect to the shaft. The ramps of the mechanism ride over the ramps fixed with respect to the shaft to displace the mechanism vertically and reciprocally. When the friction reaches a point where the friction overcomes the bias, the mechanism is held in the second vertical position by the friction between the splines.

In accordance with another aspect of the embodiment, vertical displacement of the mechanism is achieved in another manner. A camming element is located in a fixed vertical position with respect to the one shaft. The camming element includes at least one cam surface shaped in an arcuate relation with respect to the shaft, and most preferably, a helical relation. The displacable mechanism includes a cam follower that rides on the helical cam surface. The cam follower rides on the camming surface in response to changes in the torque load to move the mechanism from the first vertical position to the second vertical position.

The camming element preferably includes a plurality of protrusions that extend longitudinally from the camming element toward the mechanism. The mechanism includes a plurality of like protrusions. The protrusions have mirror image helical faces that ride against each other and move the mechanism vertically in response to increases in the torque load.

As described above, the mechanism is displacable vertically in response to changes in the torque load. The mechanism is operably connected to a transfer member. The transfer rotates with the one shaft and is slidable vertically on the shaft in response to vertical movement of the mechanism. The transfer member includes a plurality of pawls biased radially outwardly of the transfer member. The one gear train includes an annular gear having internal ratchet teeth that are engaged by the pawls. The annular gear has external gear teeth for driving one of the gear trains.

The pawls are biased radially outwardly of the transfer member into engagement with the ratchet teeth in the first vertical position of the transfer member. The pawls are movable radially inwardly against the bias out of engagement with the ratchet teeth in the second vertical position. In accordance with one aspect of the invention, the winch includes an annular flange extending radially inwardly of the internal ratchet teeth, and the flange retains the pawls out of engagement with the ratchet teeth in the second vertical position. Preferably, the flange includes a radial face that retains the pawls out of engagement once the transfer member has moved longitudinally with respect to the gear having the internal ratchet teeth.

The annular flange preferably includes a ramp on a top surface thereof for moving the pawls radially inwardly as the transfer member moves downwardly with respect to the annular gear.

In accordance with another embodiment of the invention, the winch includes a mechanism angularly displaceable in response to changes in load on the winch drum. The mechanism includes a means for engaging one of the gear trains at a first angular position and for disengaging the one gear train at a second angular position to isolate the one gear train and provide for rotation of the drum by the other gear train.

In accordance with one aspect of the embodiment, the winch drum includes a load receiving portion and a second portion, and the winch includes means for mounting the load receiving and second portions together. The mounting means permitting the load receiving and second winch drum portions to rotate a relatively small amount with respect to each other from a first rotational position to a second rotational position and including means responsive to the relatively small rotation for displacing the mechanism between the first and second angular positions.

The one gear train is engaged by the drive shaft in the first rotational position of the drum portions, and is mounted between the drive shaft and the load receiving drum portion. The other gear train is engaged by the drive shaft in the second rotational position of the drum portions, and is mounted between the drive shaft and the second winch drum portion. The means for mounting the winch drum portions together transmits torque applied to the drive shaft between the load receiving and second drum portions.

The mounting means further provides a bias opposing rotation of the load receiving and second winch drum portions toward the second rotational position, and the winch further comprises means for retaining the load receiving and second drum portions in the second rotational position while the load on the load receiving drum portion remains large enough to overcome the bias.

In accordance with another aspect of this embodiment, the mechanism comprises a pawl mounted for rotation with the drive shaft, the pawl engaging ratchet teeth on the gear on the one gear train to drive the winch drum. The mechanism further comprises an angularly displaceable ring which permits engagement of the one gear ratchet teeth by the pawl at the first angular position and blocks the one gear ratchet teeth to prevent engagement by the pawl in the second angular position. The ring includes a tab for coupling with the displacing means.

As can be appreciated, the winch according to the present invention is responsive to variations in torque load placed on the winch. If the load is very high, the winch operates in one gear train. If the load is low, the winch operates in another gear train. Other advantages of a winch in accordance with the present invention will be apparent from the following detailed description.

BRIEF DESCRIPTION OF DRAWINGS

FIGS. 2, 3 and 4 are schematic side elevations of the central drive portion of the winch of FIG. 1, in three driving modes wherein FIG. 2 shows the winch wherein the drum rotates at the highest speed with the lowest power; wherein FIG. 3 shows the winch wherein the drum rotates at a medium speed with medium power transmitted; and wherein FIG. 4 shows the winch wherein the drum rotates at the slowest speed and the maximum power is transmitted;

FIG. 13 is a partial section view along the planes 13—13 of FIG. 7;

FIG. 14 is a sectional view along the plane A—A of FIG. 13;

FIG. 15 is a sectional view along the planes 15—15 of FIG. 7; and

FIG. 16 is a sectional view along the plane B—B of FIG. 15.

DETAILED DESCRIPTION

Figure 1:
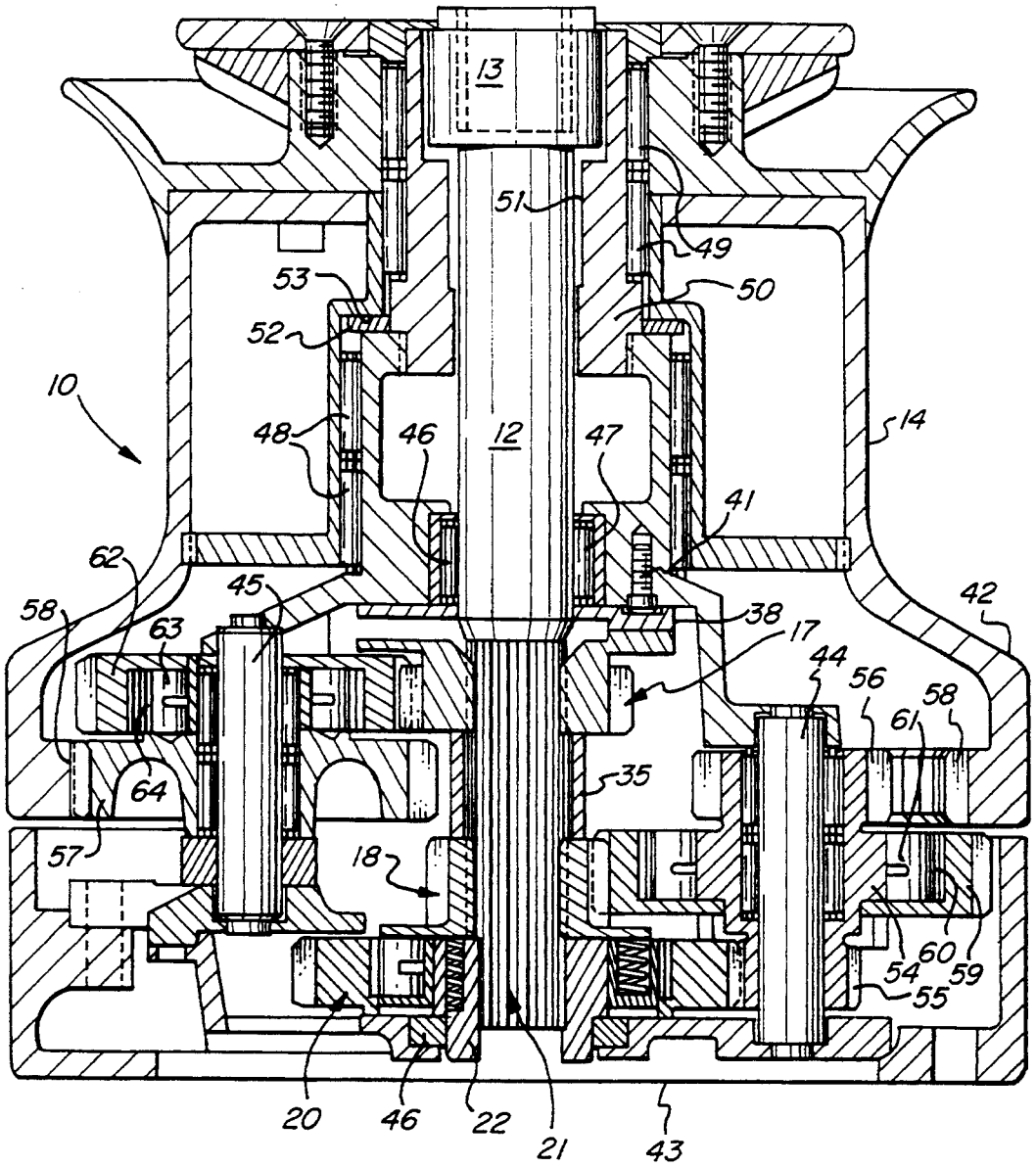
FIG. 1 is a schematic part section side elevation of a three-speed winch for use on a yacht.

In respect to FIG. 1, it should be appreciated that the winch illustrated is sectioned by two vertical planes which intersect along the axis of drive shaft 12. One plane passes through the axis of driven shaft 44 and the other plane passes through the axis of drive shaft 45.

Figure 2:
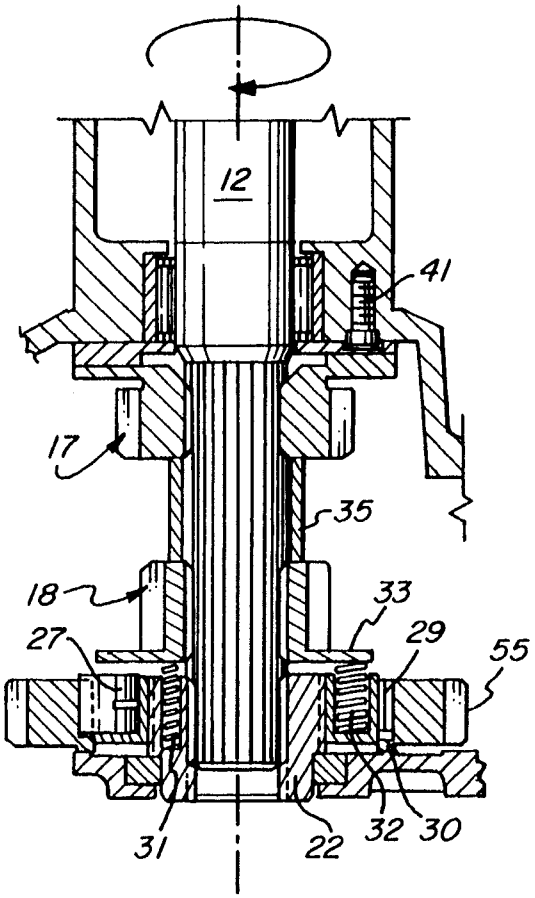

The winch 10 has a central drive assembly 11 with an input drive shaft 12. The shaft 12 has an upper-splined socket 13 which is engaged by a crank handle not shown. Surrounding the shaft 12 is a winch drum 14 which rotates clockwise when viewed from above. Referring to FIG. 2, when the shaft 12 is initially driven in a clockwise direction as shown by the arrow, rotation of the shaft 12 produces the highest rotational speed of the drum 14. If the rotation of the shaft 12 is reversed as shown in the arrow in FIG. 3, the next highest or medium speed of the drum 14 is achieved. Again, the rotational direction of the drum 14 is clockwise, despite the counter-clockwise rotation of the shaft 12. If the rotational direction is again reversed as shown by the arrow in FIG. 4 and the shaft 12 driven in a clockwise direction, the slowest speed of the drum 14 is produced. Again, the rotational direction of the drum 14 is clockwise.

This analysis of the various speeds of the drum 14 is based upon a predetermined rotational velocity of the shaft 12. The various gear arrangements associated with each of the discussed speeds of the winch 10 is schematically depicted, respectively, in FIGS. 2, 3 and 4.

Figure 3:
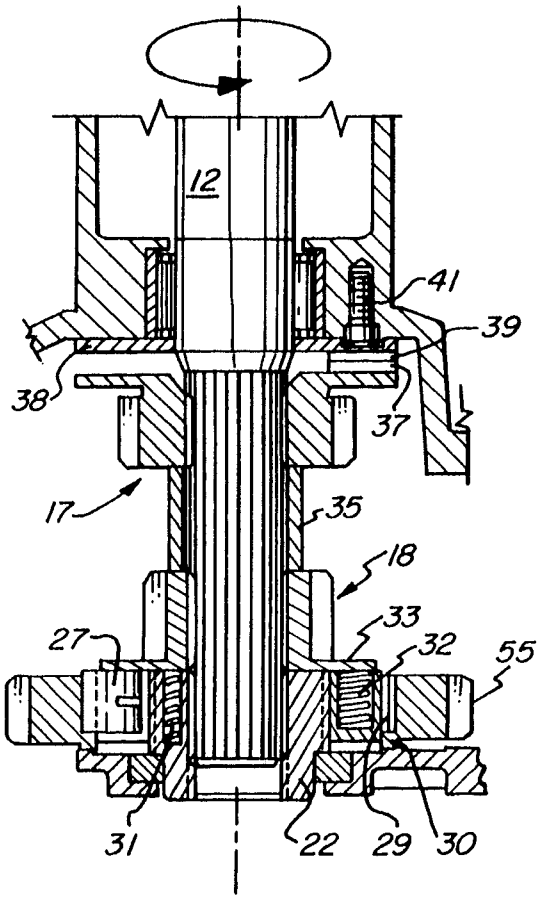

Mounted on and driven by the shaft 12 is the drive assembly 11, which drive assembly 11 includes an upper gear 17 which forms part of the gear train providing the second highest speed (FIG. 3). The gear 17 has internal splines 15, which engage the splines 16 of the shaft 12; splines 15 and 16 prevent rotation of gear 17 with respect to shaft 12 but permit 17 to slide longitudinally with respect to shaft 12. The drive assembly further includes an intermediate gear 18 which forms part of the gear train of the lowest speed (FIG. 4. The gear 18 has internal splines 19 which are engaged with the splines 16. The highest speed gear train includes a gear 20, which forms part of the drive assembly 11. The gear 20 is selectively driven by a ratchet and pawl mechanism 21.

The ratchet and pawl mechanism includes a base 22 which has internal splines 23 meshed with splines 16. The base 22 is also provided with external splines 24 which engage the internal splines 25 of a transfer member 26. The transfer member 26 is provided with a pair of pivotally mounted pawls 27 which are resiliently biased radially outward by means of springs 28. The pawls 27 engage ratchet teeth 29 formed internally on the gear 20. The gear 20 is also provided with an annular flange 30 that extends radially inwardly.

The base 22 is fixed to the shaft so as not to be movable longitudinally thereof. On the other hand, the transfer member 26, gear 18 and gear 17 are movable longitudinally of the shaft 12.

Figure 4:
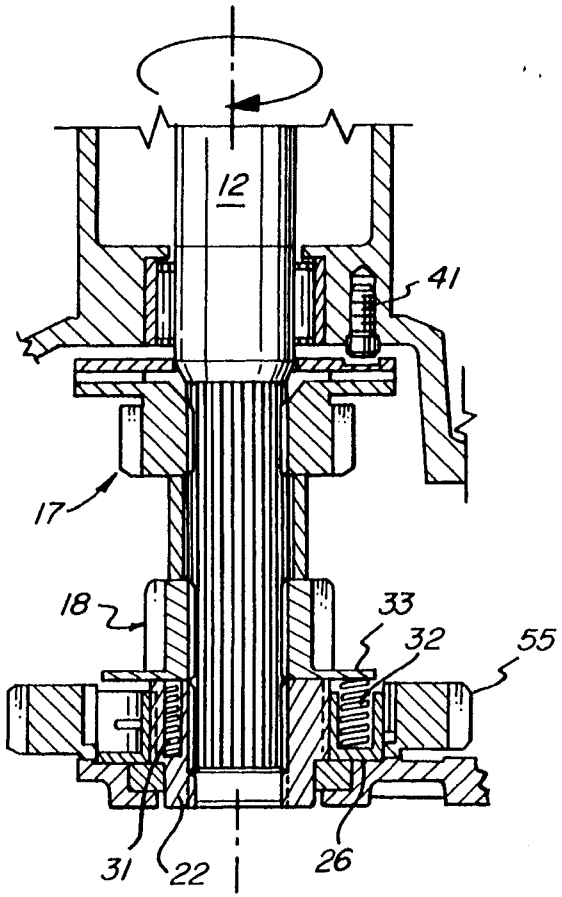

Referring to FIGS. 2–4, extending between the base 22 and gear 18 are springs 31, while extending between the transfer member 26 and the gear 18 are springs 32. To provide an abutment for the springs 32, the gear 18 is provided with an annular flange 33 that extends radially outwardly. Rotation of the gear 18 relative to the transfer member 26 is prevented by screws 34*a*, which are fixed to the transfer member through insertion in threaded holes 34*b*, but pass through apertures in the flange 33, so that the gear 18 may move longitudinally of the shaft relative to the transfer member 26. Extending between the gears 17 and 18 is a spacer sleeve 35, best shown in FIGS. 2–4.

Figure 5:
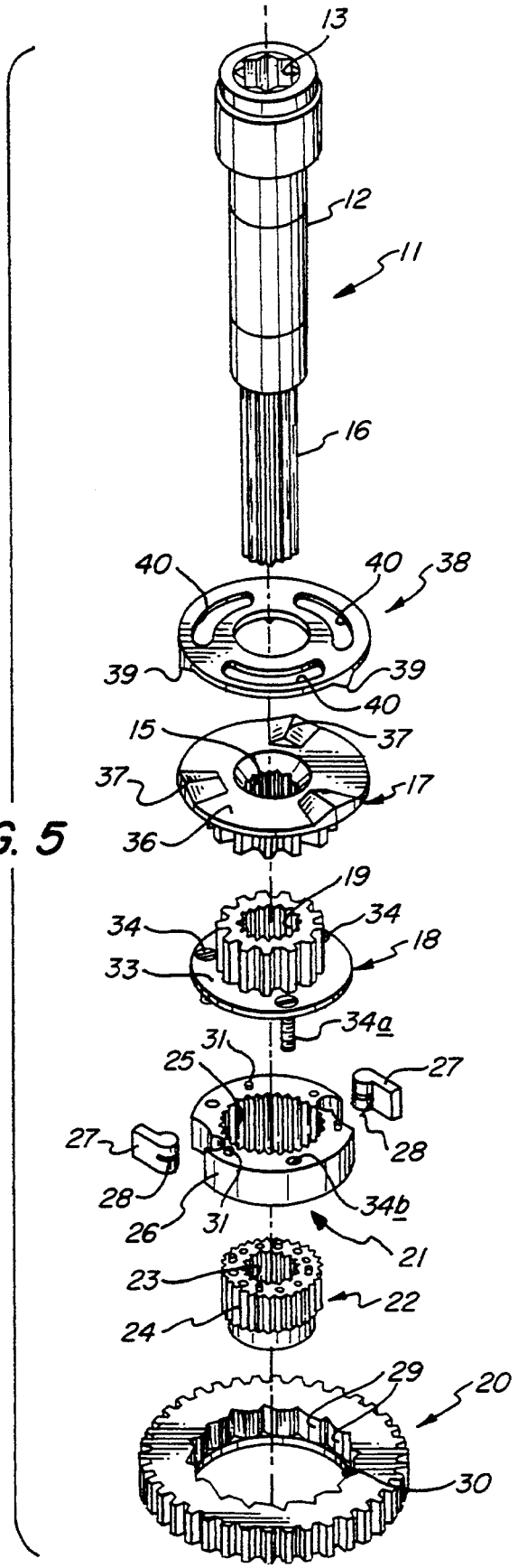
FIG. 5 is a schematic part exploded perspective view of the central drive portion of the winch of FIG. 1.
Figure 6:
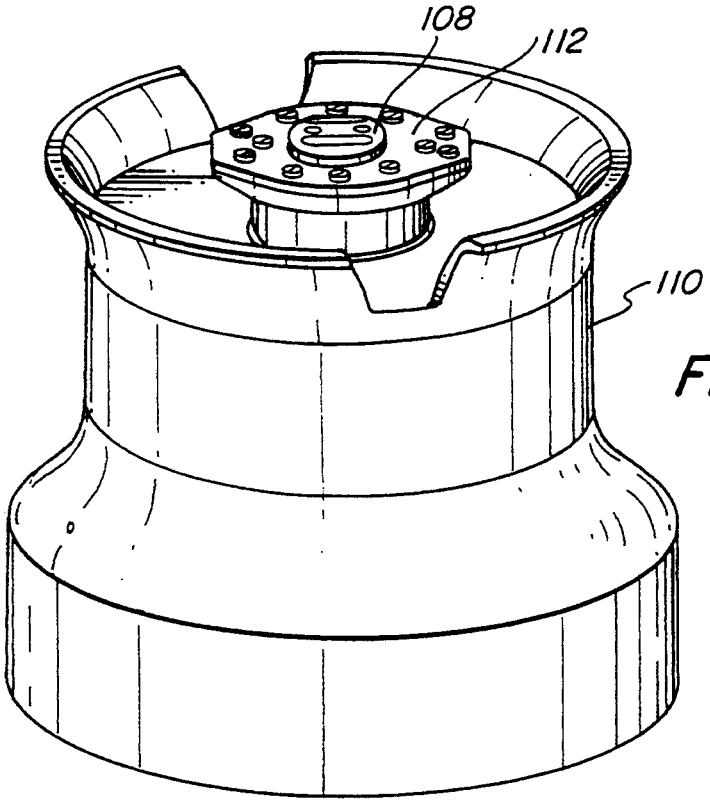
FIG. 6 is a perspective view of another winch in accordance with the present invention.

Referring to FIGS. 3 and 5, the gear 17 has an annular flange 36 provided with a plurality of spaced-apart ramp surfaces 37. Positioned above the gear 17 is a plate 38 which has a plurality of spaced-apart ramp surfaces 39 positioned to ride over the ramp surfaces 37, which cause gear 17 to reciprocate longitudinally with respect to plate 38. As shown in FIG. 3, the gear 17 has been forced downwardly by a distance equal to the height of one of the ramps 37 and 39. The plate 38 has annularly extending slots 40 which receive one or more pins 41 to hold the plate 38 stationary.

Referring to FIG. 1, the winch 10 has a main body 42 with with a base plate 43 to be secured to a supporting structure. The base plate 43 and the associated gear housing support a pair of parallel driven shafts 44 and 45, as well as rotatably supporting the drive shaft 12 by bearings 46 and 47. The drum 14 is rotatably supported on the body 42 by bearings 48 and 49. The bearings 49 engage a spacer 50 which also rotatably supports the shaft 12 via a bearing 51. A thrust bearing 52 extends between the spacer 50 and an abutment surface 53 of the drum 14. The spacer 50 finds support on the base plate 43.

Rotatably supported by the shaft 44 is a gear member 54, which includes a first gear 55 meshingly engaged with the gear 20. The gear member 54 has an upper gear 56, which is meshingly engaged with a further gear 57 rotatably supported by the shaft 45. The gear 57 engages an internal ring gear 58 which is part of the drum 14.

Also rotatable about the shaft 44 is a gear 59 which is meshingly engaged with the gear 18. The gear 59 engages the gear member 54 via ratchet teeth 60 and pawls 61. The pawls 61 are pivotally mounted on the gear member 56 and are provided with springs to bias them radially outward into engagement with the ratchet teeth 60.

Also rotatably supported on the shaft 45 via the gear 57 is a gear 62. The gear 62 engages the gear 57 via pawls 63 which are pivotally mounted on the gear 57. The pawls 63 engage ratchet teeth 64 formed on an internal surface of the gear 62. The gear 62 is meshingly engaged with the gear 17, with the gears 17 and 62 providing the intermediate speed (FIG. 3).

In operation of the above described winch 10, when the shaft 12 is initially rotated in the clockwise direction, the drum 14 is driven clockwise via the gears 20, 55, 56, 57 and 58. Since the gear member 54 has a relatively high rotational speed, the pawls 61 override the ratchet teeth 60 so that there is no transfer of motion between the gear 59 and gear member 54. Accordingly, the gear 18 is effectively isolated. The gear 17 is also effectively isolated since the pawls 63 override the ratchet teeth 62 since the gear 64 is being driven in the wrong direction. This particular arrangement gives the highest rotational speed to the drum 14 for a given rotational speed of the shaft 12.

When the rotational direction of the shaft 12 is reversed, that is it is rotated counter-clockwise, the drum 14 is driven by the gears 17, 62, 57 and 58. The pawls 63 engage the ratchet teeth 64 as they are being driven in the correct direction. The pawls 27 and 61 override their respective teeth 30 and 60 since they are being driven in the opposite direction for driving engagement. Accordingly, gears 18 and 20 are effectively isolated. This particular gear arrangement gives the next highest rotational speed to the drum 14 for a given rotational speed of the shaft 12 in an counter-clockwise direction.

The lowest rotational speed of the drum 14 is provided by the gears 18, 59, 56, 57 and 58. The rotational power is transferred via the gear member 54 and pawls 61 and ratchet teeth 50. However, for power to be transferred via these gears, it is necessary to isolate the gear 20. This is achieved by axial downward movement of the transfer member 26 so that its pawls 27 are pushed radially inwardly and are retained by the flange 30 so that they are no longer engaged with the ratchet teeth 29. This then effectively isolates the gear 20.

Movement of the transfer member will now be described. The transfer member 26 needs to be moved downwardly and longitudinally of the shaft 12 to isolate the gear 20. Upward movement of the transfer member 26 is also required to reinstate connection between the transfer member 26 and the gear 30. This movement of the transfer member 26 is effected by the springs 31, 32 and interaction of the ramp surfaces 37 and 39. In the initial position, the pawls 27 are engaged with the teeth 29 to transfer power between the transfer member 26 and the gear 20. When in this position, the springs 31 bias the gear 18 together with the spacer 35 and gear 17 upward. However these items are caused to reciprocate vertically due to the ramp surfaces 37 riding over ramp surfaces 39. The relative movement between the gear 18 and the transfer member 26 is accommodated by the springs 34. It should be appreciated that the transfer member 26 cannot move downward to a position causing disengagement of the pawls 27, due to the pawls 27 being engaged with the ratchet teeth 29 and abutting the radial upper surface of the flange 30.

When the rotational speed of the shaft 12 is reversed to drive via the gear 17, the gear 17 is moved downward to the position shown in FIG. 3 due to the engagement of the ramp surfaces 37 and 39, forcing with it the sleeve 35 and gear 18. The gear 17 is retained in this downward position by the friction between the splines 15 and the splines 16. More specifically, an increase in friction is generated by the increased load being transferred between the splines 15 and the splines 16. By being retained in a downwardly-spaced position, the gear 17 compresses the springs 31 and 32 biasing the transfer member 26 downward. Since the pawls 27 are now going in the opposite direction to their driving direction, they are being continually displaced radially inward by a distance sufficient to clear the flange 30. At the same time, due to the transfer member 26 being biased downward, the pawls 27 will eventually be retained radially inwardly by the flange 30.

Accordingly, when the rotational direction of the shaft 12 is again reversed, the gear 20 is effectively isolated due to the pawls 27 being retained radially inwardly by flange 30 and being disengaged from the teeth 29. Thus, the drum 14 will be driven by the gears 18 and 59.

When the torque load on the winch falls below an amount which created sufficient friction between the splines 15 and the splines 16 to retain the gear 17 in the downward position, the gear 17 is biased upwardly to the position shown in FIG. 2 wherein the pawls 27 once again engage teeth 29 to drive the winch at the highest speed.

To prevent "chattering" engagement between the ramps surfaces 37 and 39 when the gear 17 is held in its downwardly spaced position, the plate 37 is not fixed to the body 42. Accordingly, the plate 38 is permitted to fall from engagement with the pins 41 and therefore rotate with the gear 17.

Referring to FIGS. 6 through 16, another embodiment of a winch in accordance in the present invention will now be described.

Figure 7:
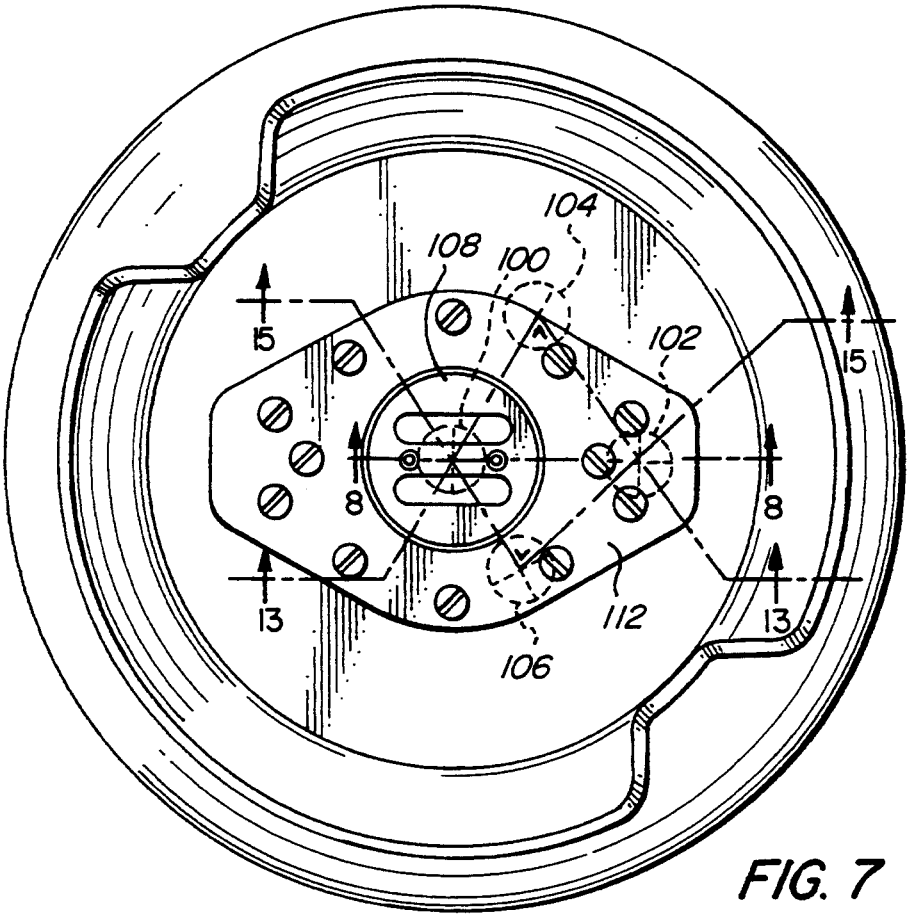
FIG. 7 is a top view of the winch shown in FIG. 6.

The winch shown in these Figures has four speeds. Referring primarily to FIG. 7, but also FIGS. 8, 13, and 15, the winch includes a main drive shaft 100 which is driven from below in a conventional manner. The winch also includes three driven shafts 102, 104, and 106. As shown in FIGS. 6, 7, 8, and 9, the winch includes a top drive button 108 for manually engaging the initial gear of the winch. The drive button 108 and its associated transfer mechanism 109 is held within the winch drum 110 by a top cover plate 112 which covers the internal components of the winch and retains button 108.

Figure 8:
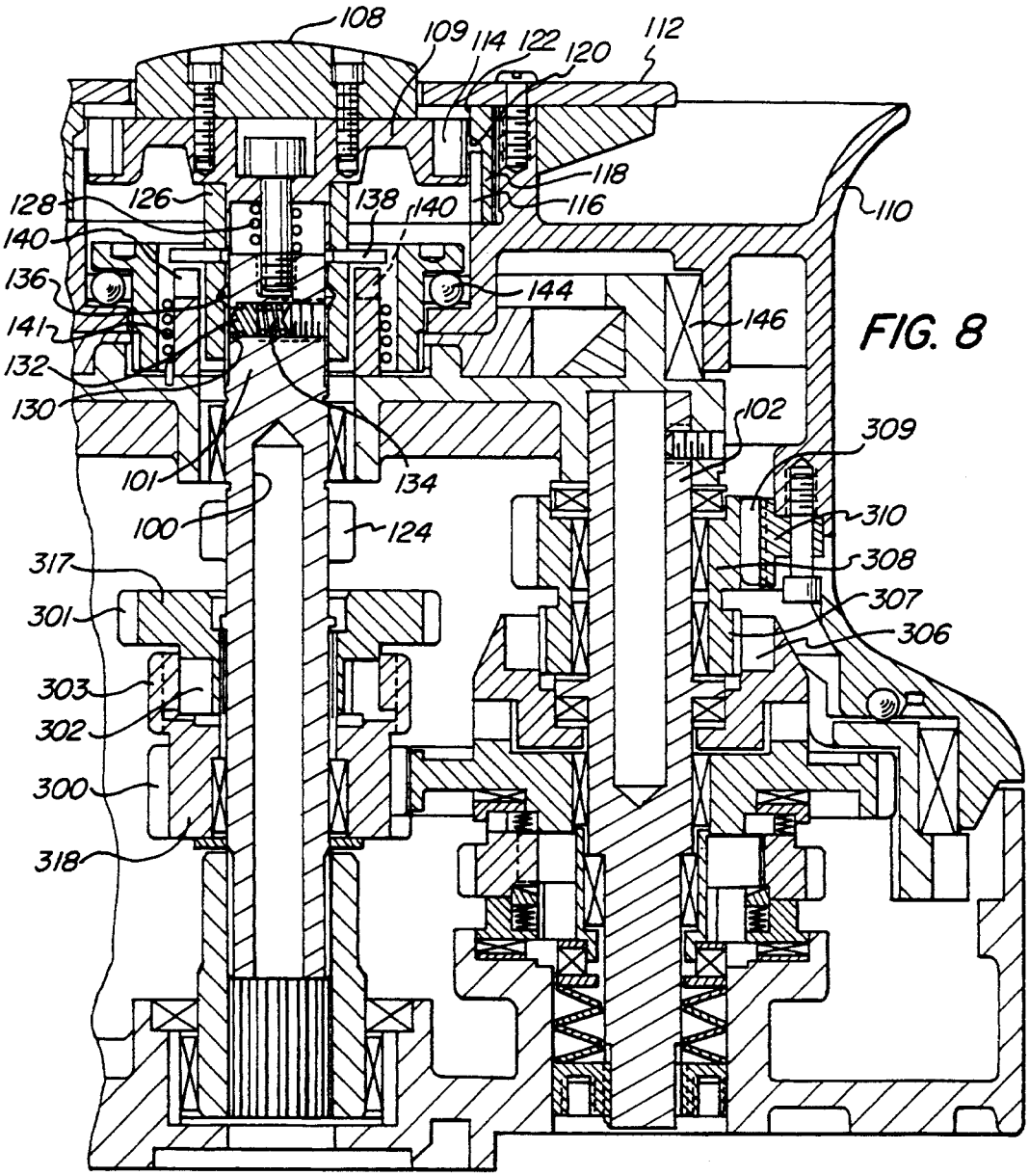
FIG. 8 is a sectional view along the plane 8—8 of FIG. 7.
Figure 9:
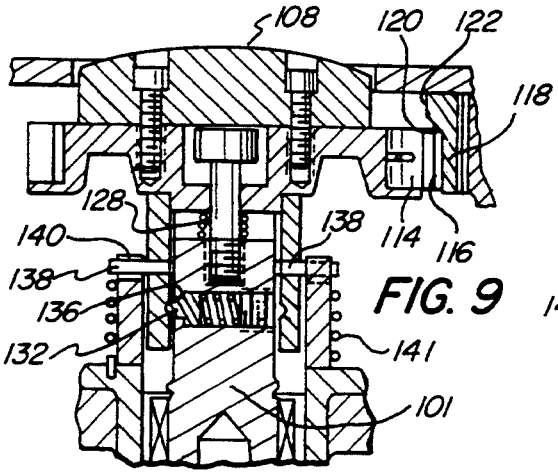
FIG. 9 is a view similar to that shown in FIG. 8, except that the button on the top of the winch has been depressed and retained in a depressed position.

The engagement of the initial gear train will now be described. Referring to FIGS. 8 and 9, the initial gear train is driven by engagement of pawls 114 with ratchet 116 of an annular gear 118 that is connected to drum 110. More specifically, referring to FIG. 9, pawls 114 are biased outwardly into engagement with ratchet teeth 116 when the button 108 is in the downward position of FIG. 9. At this point the shaft is rotating in a clockwise direction when viewed from above. The shift from this initial gear to the first gear will be described by comparison between FIGS. 8 and 9.

Referring to FIG. 8, when the button 108 is released and moved vertically upwardly to the position shown in FIG. 8, the pawls 114 as they move upwardly contact ramp 120 and are urged radially inwardly against the bias on the pawls to a position wherein the pawls are retained out of engagement with ratchet teeth 116. More specifically, the pawls are retained by the radial face 122 out of engagement so that when a drive shaft 100 rotates in the clockwise direction, the pawls 114 are out of engagement with respect to the ratchet teeth 116. The principal by which pawls 114 are retained radially inwardly against engagement with ratchet teeth 116 is better described with respect to FIG. 11, which is a different pawl mechanism within the winch, but this pawl mechanism functions in a similar manner.

The operation of button 108 will now be described. FIG. 8 shows the button in a first vertical position while FIG. 9 shows the button in a second vertical position wherein the button has been moved downwardly. The button is mounted to a second drive shaft section 126 and is slidable vertically with respect to the main section 101 of drive shaft 100. The second shaft section 126 is biased longitudinally upwardly by the spring 128 and is movable vertically downwardly to compress the spring 128 as shown in FIG. 9. The main section of shaft 100 includes a radial opening 130 that has a pin 132 movable out of the opening and biased by a spring 134. The internal cylindrical surface of shaft section 126 includes a pin receiving detent 136. As shown a comparison between FIG. 8, when the button 108 is pushed downwardly, pin 132 fits within detinet 136 to retain said button in the lower vertical position and provide for engagement of pawls 114 with ratchet teeth 116.

Figure 10:
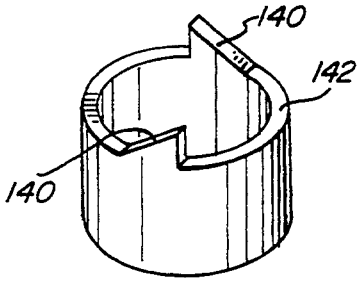
FIG. 10 is a perspective view of the ramp shown in FIGS. 8 and 9.

The drive shaft 100 is rotating in a clockwise direction in the initial gear speed. In order to change speeds, the person operating the winch rotates the drive shaft in a counter-clockwise direction and the winch will be in second speed. After the shaft 100 has been rotated through an angle of at least 180 degrees, the pins 138, which extend radially outwardly of drive shaft section 126, ride up on ramps 140. The ramps 140 are best shown in FIG. 10 which shows a cylindrical support 142 that has ramps 140 protruding upwardly therefrom. The ramps are located 180 degrees apart, and provide a surface which urges pins 138 vertically upwardly as the drive shaft 100 is rotated in a counter-clockwise direction. A spring clutch 141 permits rotation of support 142 in a clockwise direction and locks support 142 against rotation in a counter-clockwise direction. The force of pins 138 against ramps 140 is sufficient to overcome the spring 134 that retains pin 132 into engagement with detent 136. Thus, the button 108 pops vertically upwardly from the position in FIG. 9 to the position shown in FIG. 8, which disengages the pawls 114 from the ratchet teeth 116.

Once the person operating the winch sees that the button has popped up, he can continue to rotate the drive shaft in a counter-clockwise direction and will be in second gear. As will be described in detail later, if the drive shaft is rotated in the clockwise direction, the winch will be in the first or third gear, depending on the torque load. In both the initial speed and the first speed of the winch, the shaft is rotated in the same direction, and thus, the interaction between pawls 114 and 116 must be removed in order for the shaft 100 to drive the winch in the first speed via gear 124.

As can be appreciated, the winch includes a wide variety of thrust bearings which are generally indicated by circular spheres shown at reference character 144. The winch also includes a wide variety of roller bearings 146 which are generally indicated by an X through a rectangular box. These are of conventional operation and need not be described further.

Thus, a person operating the winch gets into the initial winch speed by pressing down button 108 and rotating the shaft in a clockwise direction. As soon as the person rotates the drive shaft in a counter-clockwise direction, the button moves upwardly and disengages the initial speed and thus engaging pawls 114 with ratchet teeth 116. At this point in time, the person rotating the shaft has two options. He can continue to rotate the shaft in a counter-clockwise direction and drive the winch in the second speed, which is the only winch speed that is driven by rotation of the drive shaft in a counter-clockwise direction.

The person has the option of rotating the drive shaft in a clockwise direction and the winch will be in first or third gear, depending on the torque load. The automatic load responsive feature of the winch will now be described by comparing FIGS. 13 and 14 on the one hand with FIGS. 15 and 16 on the other hand. It would be helpful for the reader to align FIGS. 13 and 15 in side-by-side relation so that the vertical movement of certain components on driven shaft 102 can be seen. FIG. 13 shows the winch in the first speed, which is a speed that is between the initial speed and the second speed. FIG. 15 shows the winch in the third speed, which is the slowest speed. In both the first speed and the third speed shown in FIGS. 13 and 15, the drive shaft 100 rotates in a clockwise direction.

When the winch has a substantial torque load, the winch is in the position shown in FIG. 15. If the torque load slackens, the winch is in the position shown in FIG. 13.

Referring to FIGS. 13 and 15, a camming element 150 is located in a fixed vertical position with respect to driven shaft 102. A cam follower mechanism 152 moves from a first vertical position shown in FIG. 13 to a second vertical position shown in FIG. 15. The parts described with respect to FIGS. 13 and 15 are also shown in exploded perspective view in FIGS. 11 and 12. In the right-hand side of FIGS. 13 and 15, the camming element 150 and the cam follower mechanism 152 is shown in a side sectional view so that the working of the camming surfaces and the camming element can be better understood.

As shown in FIGS. 13 and 15, the displacable cam follower mechanism 152 is movable from the first vertical position shown in FIG. 13 to the second vertical position shown in FIG. 15. In addition, the mechanism 152 rotates from a first rotational position to a second rotational position offset from said first rotational position by a distance 154 shown in FIG. 15. The camming element 150 includes at least one and preferably several camming surfaces 156 shaped in an arc, and preferably shaped in a helical relation with respect to the shaft 102. The camming surface 156 abuts a cam follower 158 on said mechanism 152. Thus, the mechanism 152 moves in a helical pattern from the position shown in FIG. 13 to a position shown in FIG. 15.

The mechanism 152 is biased upwardly to the position shown in FIG. 13 by a series of conical springs 160 which are also known as "Belleville" springs. The Belleville springs 160 urge mechanism 152 upwardly. The mechanism 152 is movable downwardly against the bias springs 160. In accordance with one aspect of the invention, the springs are accessible by cover 162 so that the spring tension can be changed if desired.

As the torque load on the winch increases, the mechanism 152 begins to move vertically and rotate from the position shown in FIG. 13 to the position shown in FIG. 15 through the transmission of a torque load into vertical displacement of member 152. As will be described subsequently, the difference in position of the mechanism 152 provides for engagement of different gear trains.

Figure 11:
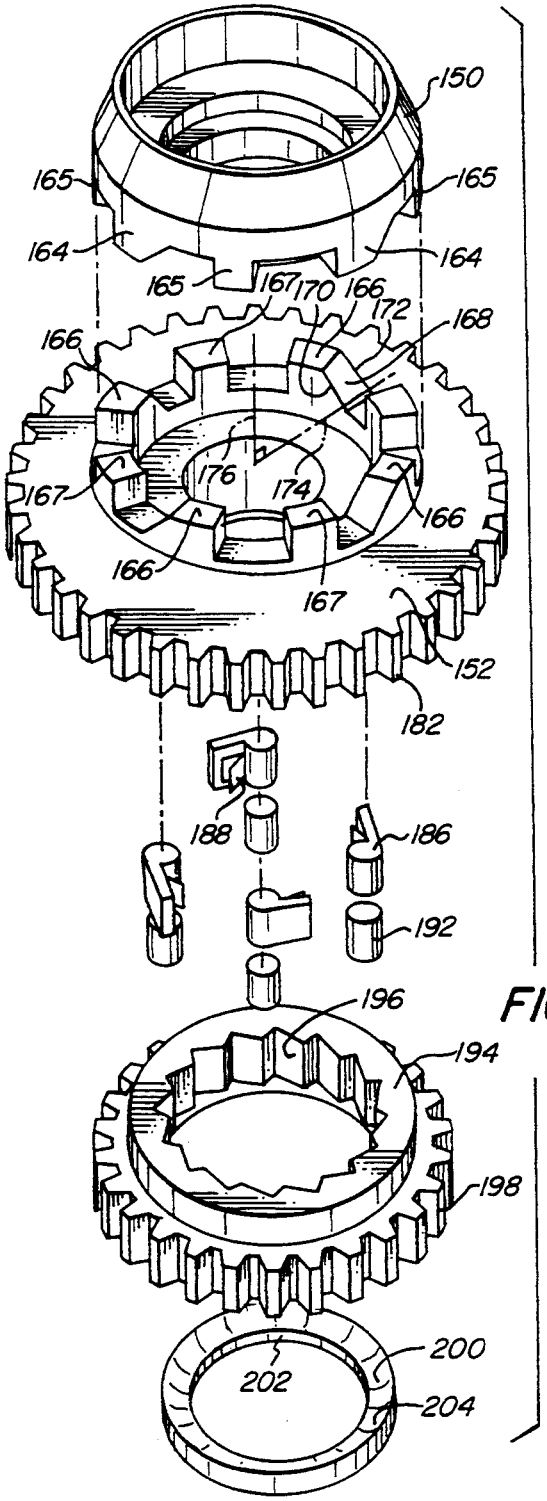
FIG. 11 is a perspective exploded view of the essential components for shifting between gear trains in respect to variations in torque load.

The specific structure of the helical camming surfaces will now be described with reference to FIGS. 11, 12 and 13. The camming element includes a plurality of protrusions 164 that extend longitudinally from the camming element 150 toward the mechanism. The protrusions of the camming element 150 are essentially the mirror image of the cam followers 166 of mechanism 152. Each camming surface 164 and 166 includes a face 168 that is bounded by two edges 170 and 172.

The edges 170 and 172 are part of two concentric helices that extend in a helical shape with respect to shaft 102. The face 168 lies in a line 174 that passes between both edges 170 and 172 and the axis of the shaft wherein the line is perpendicular to the shaft axis. More specifically, referring to FIG. 11, line 174 is perpendicular to shaft axis 176 and intersects both edge 170 and edge 172. In addition, if one were to envision moving the line vertically and rotating it at the same time, the face 168 would always be coincident with the lines 174, in the preferred embodiment of the invention.

In accordance with a preferred embodiment of the invention on both the mechanism 152 and the camming element 150, there are four camming protrusions for each part located in a circular path with respect to the shaft axis. Each camming protrusion 166 on the mechanism 152 has a mirror image camming protrusion 164 and the camming element 150.

The camming protrusions are spaced apart and have located therebetween a series of rectangular protrusions 165 and 167 spaced equally about the shaft axis 176 in the same circular path. These protrusions 165 and 167 form stop surfaces that define the first and second positions of the mechanism 152. More particularly, referring to a comparison between FIGS. 13 and 15, the surface 178 of protrusion 165 contacts the surface 180 of the protrusion 167 when the mechanism moves from the position shown in FIG. 13 to the position shown in FIG. 15.

Preferably, the camming element 150 as shown in FIGS. 11 through 15 has the mirror image of the protrusions of mechanism 152 including the various stop surfaces and the camming protrusions.

The mechanism 152 also includes outwardly extending gear teeth 182 that engage with similar teeth on shaft 106 as shown in FIG. 15.

Figure 12:
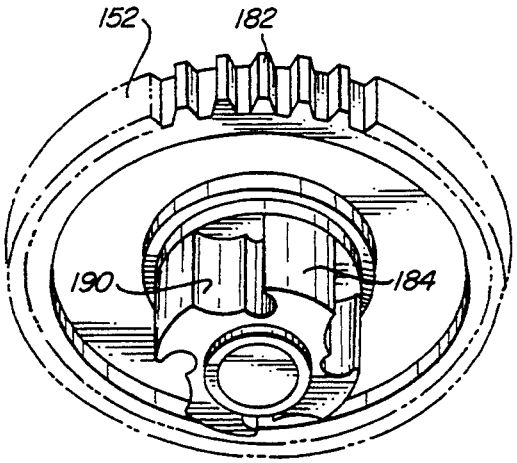
FIG. 12 is a perspective view of the bottom of one of the parts shown in FIG. 11.

The mechanism 152 preferably includes a transfer member 184 that is shown in perspective in FIG. 12 and that is shown in two sectional views in FIGS. 14 and 16. The transfer member is preferably integral with mechanism 152 and includes a series of pawls 186 that are biased radially outwardly by springs 188 as shown in FIG. 14. The pawls are movable radially inwardly against the bias of spring 188 as shown in FIG. 16. As shown in FIG. 12, the pawls 188 are inserted into pawls cavities 190 and the transfer member 184. Spacer elements 192 are shown in FIG. 11 are inserted after the pawls have been inserted.

The pawls 186 drive an annual gear 194 which has internal ratchet teeth 196 and external drive teeth 198. In the position shown in FIG. 13, the pawls 186 are biased radially outwardly into engagement with ratchet teeth 196. Thus, when shaft 102 is turned, the pawls engage ratchet teeth 196 and drive the gear. In the position shown in FIG. 15, the transfer member and the pawls have moved longitudinally downwardly so that the pawls 186 are retained radially inwardly out of engagement with ratchet teeth 196. More specifically, an annular flange 200 extends beneath the internal ratchet teeth. The flange 200 includes a radial face 202 that retains the pawls out of engagement with the ratchet teeth 196. Preferably, the annular flange includes a ramp 204 from the upper surface thereof which helps urge the pawls radially inwardly as the transfer member moves downwardly.

As best shown in a comparison between FIGS. 14 and 16, the pawls 186 are now retained radially inwardly and out of engagement with ratchet teeth 196 by the face 202.

When the winch is in the second speed, and the drive shaft 100 is being rotated in a counter-clockwise direction, the teeth 182 of the mechanism 152 are always engaged, and the torque load on the winch is sensed by the camming element 150 sliding with respect to the cam follower mechanism 152.

When the direction of drive shaft 100 is changed from counter-clockwise to the clockwise motion, if there is a heavy torque load on the winch, the ratchets 186 are held out of engagement with internal ratchet teeth 196 and, therefore, annular gear 194 is effectively isolated. In the event that the tension load falls, the cam follower mechanism 152 moves vertically upwardly to re-engage pawls 186 with ratchet teeth 196 to drive the winch.

In order to better understand the operation of each of the four gear trains, each gear train will now be described in detail.

Initial Gear Train

Drive shaft 100 is rotated clockwise. This rotates the drum 110 by means of pawls 114 and ratchets 116. When the winch is driven in the initial gear, it is also driving portions of the first gear and third gear drive trains. Since both of these gears are slower speeds, the winch actually overruns these gears by means of pawls and ratchets. First gear is trying to drive the winch through gear 301 in FIG. 8 which is fixed to the input shaft 100. Gear 301 drives gear 304, in FIG. 13. Gear 304 is part of shaft 104 which drives integral gear 305. Gear 305 drives gear 198 in FIG. 11. Pawls 186, which are part of mechanism 152, engage ratchets 196 and drive mechanism 152. This torque is transferred through the protrusions to camming element 150. Combining element 150 has pawls 306 which ride in it and try to drive ratchets 307 in drive pinion 308. The ratchets 307 are moving faster than the pawls 306 due to the drum 110, which is being driven through the initial drive, being attached to the ring gear 310 which drives gear 309 which is part of pinion 308. This explains how first gear is overrun. Third gear is also being driven but it too is being overrun. Third gear is driven from gear 311 on the drive shaft 100, FIG. 15, driving gear 312. Gear 312 has ratchets 313 cut on its inside diameter which trey to drive pawls 314. Pawls 314 are actually overrunning the ratchets 313. This is caused by first gear driving gear 152 which drives gear 315 on the shaft 106 which causes pawls 314 to overrun ratchets 313. Pawls 314 ride in ratchet hub 316 which is attached to shaft 106. A clockwise rotation of shaft 100 causes pawls 302 to ratchet on ratchet 303. These are the second speed ratchets. This ratcheting disables second gear from driving.

First Gear Train

First gear is also driven by a clockwise rotation of input shaft 100. Button 108 must be in the up position and the winch must only be lightly loaded to drive in this gear. First gear must only be lightly loaded to drive in this gear. First gear is driven through gear 301 in FIG. 8 which is fixed to the drive shaft 100. Gear 301 drives gear 304 in FIG. 13 Gear 304 is part of shaft 104 which also has part of it gear 305. This gear drives gear 198 in FIG. 11. Pawls 186, which are part of mechanism 152, engage ratchets 196 and drive mechanism 152. This torque is transferred through to camming element 150. Camming element has pawls 306 which ride in it and drive ratchets 307 in pinion 308. This drive pinion 308 which includes gear 309. Gear 309 drives ring gear 310 which drive the drum 110. Third gear is also being driven but it too is being overrun. Third gear is driven from gear 311 on the drive shaft 100, FIG. 15, driving gear 312. Gear 312 has ratchets cut on its inside diameter which try to drive pawls 314. Pawls 314 are actually overrunning the ratchets 313. This is caused by first gear driving mechanism 152 which drives gear 315 on the shaft 106 which causes pawls 314 to overrun ratchets 313. Pawls 314 ride in ratchet 316 which is attached to shaft 106. A clockwise rotation of shaft 100 causes pawls 302 to ratchet on ratchet 303. This ratcheting disables second gear from driving.

Second Gear Train

Second gear is driven by a counter-clockwise rotation of shaft 100. Gear 317 which is fixed to shaft 100 has pawls 302 which engage ratchets 303. This drives gear 318 which has gear teeth 300. This drives gear 182 which is part of mechanism 152. This torque is transferred through to camming element 150. Camming element 150 has pawls 306 which ride in it and drive ratchets 307 in pinion 308. This drives pinion 308 which includes gear 309. Gear 309 drives ring gear 310 which drives the drum 110. The counter-clockwise rotation of shaft 100 also tries to drive first gear and third gear backwards. This action just ratchets pawls. When driving first gear in a counter-clockwise direction, gear 301 drives gear 304. Gear 304 is attached to shaft 104 which has gear 305. Gear 305 is part of annular gear 194 which has ratchets 196. These ratchets ride over pawls 186, driving third gear in a counter-clockwise rotation drives gear 311 which drives gear 312. Gear 312 has ratchets 313 which ratchet on the pawls 314 thereby not driving in third gear.

Third Gear Train

Third gear is driven by a clockwise rotation of the drive shaft 100 when the winch is highly loaded and the top drive button is in the up position. Third gear drives through gear 311 which is attached to the drive shaft 100 and drives gear 312. The ratchets 313 on the inside diameter of gear 312 drive pawls 314 which are positioned in ratchet hub 316, which drives shaft 106. Gear 315, which is part of shaft 106, drives gear 182. Gear 182 is part of mechanism 152. This torque is transferred through to camming element 150. Camming element 150 has pawls 306 which ride in it and drive ratchets 307 in pinion 308. This drives pinion 308 which includes gear 309. Gear 309 drives ring gear 310 which drives the drum 110. First gear is trying to drive the inch through gear 301 in FIG. 8 which is fixed to the drive shaft 100. This drives gear 304 in FIG. 13. Gear 304 is part of shaft 104 which also has part of it gear 305. Gear 305 drives gear 198 in FIG. 11. Pawls 186, which are part of part 152, are held closed and unable to engage ratchets 196 by ring 202, thereby eliminating first gear. A clockwise rotation of shaft 100 causes pawls 302 to ratchet on ratchet 303. This ratcheting disables second gear from driving.

Figure 17:
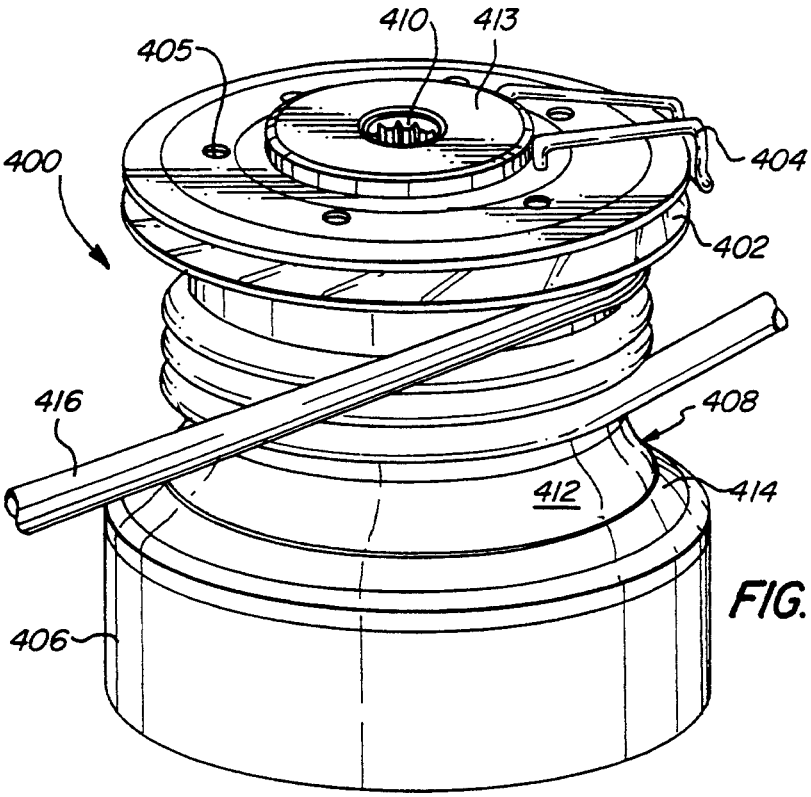
FIG. 17 is an isometric view of still another winch in accordance with the invention.

With reference to FIGS. 17–30, another embodiment of a winch in accordance with the invention is described below. Winch 400 has three speeds and, as illustrated in FIG. 17, includes a self tailing pulley 402 and line guide 404 mounted with nuts 405. It is understood that a non-self-tailing version of winch 400 is possible by excluding pulley 402, line guide 404 and associated components (not shown in any Figure).

Winch 400 comprises a base 406, a winch drum 408, and a drive shaft 410 for rotation by a crank, motor or the like (not shown in any Figure) around axis X to drive winch drum 408. Drive shaft 410 is a component of a main drive assembly 411 which may be disassembled from winch drum 408 by removing top cover 413.

Winch drum 408 comprises a load receiving portion 412 and a second portion 414. It is understood that the design, construction, function and operation of winch drum portions 412, 414 could substantially be reversed from that described below.

Figure 18:
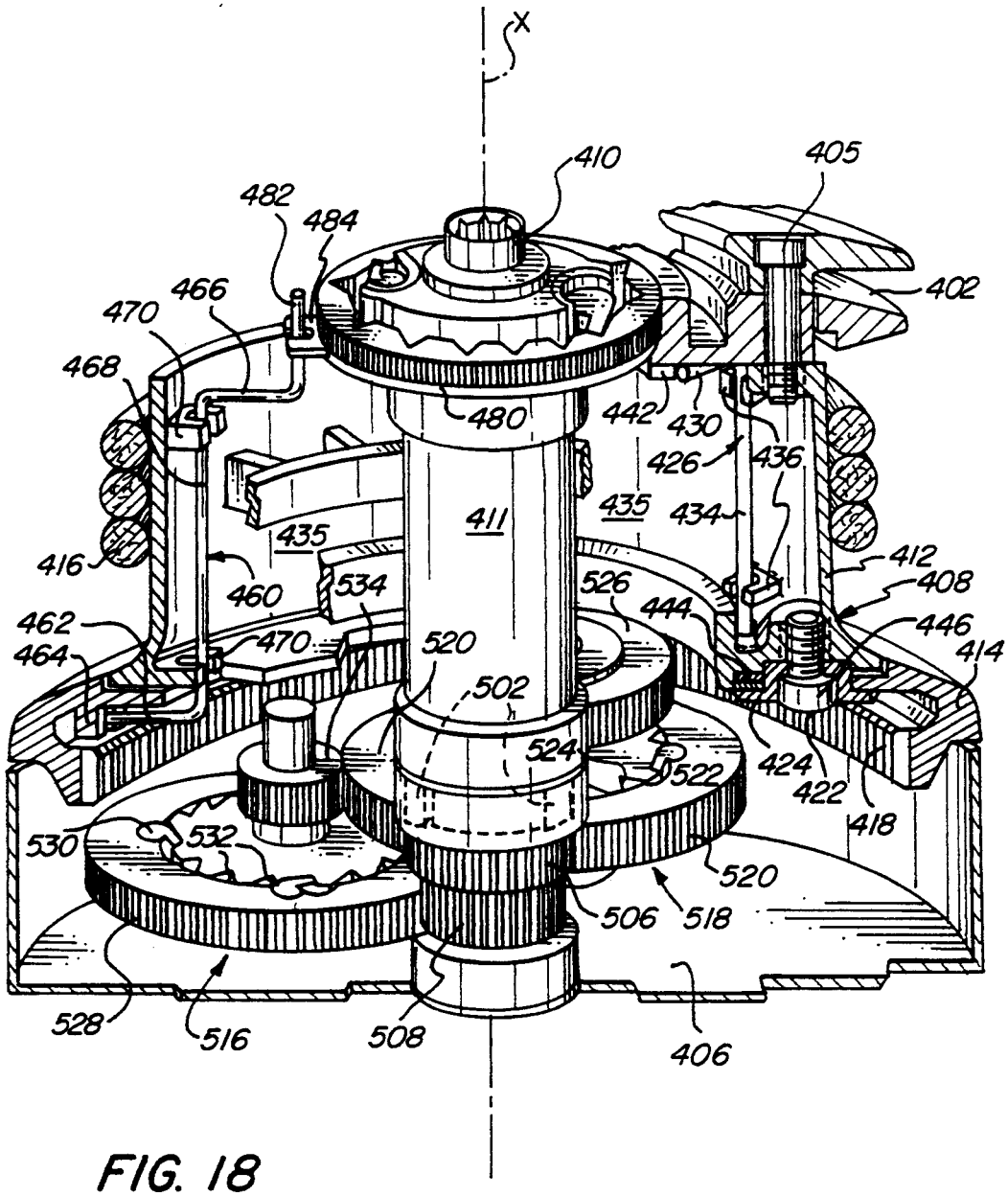
FIG. 18 is a partially cut away isometric view illustration the inner workings of the winch of FIG. 17.
Figure 19:
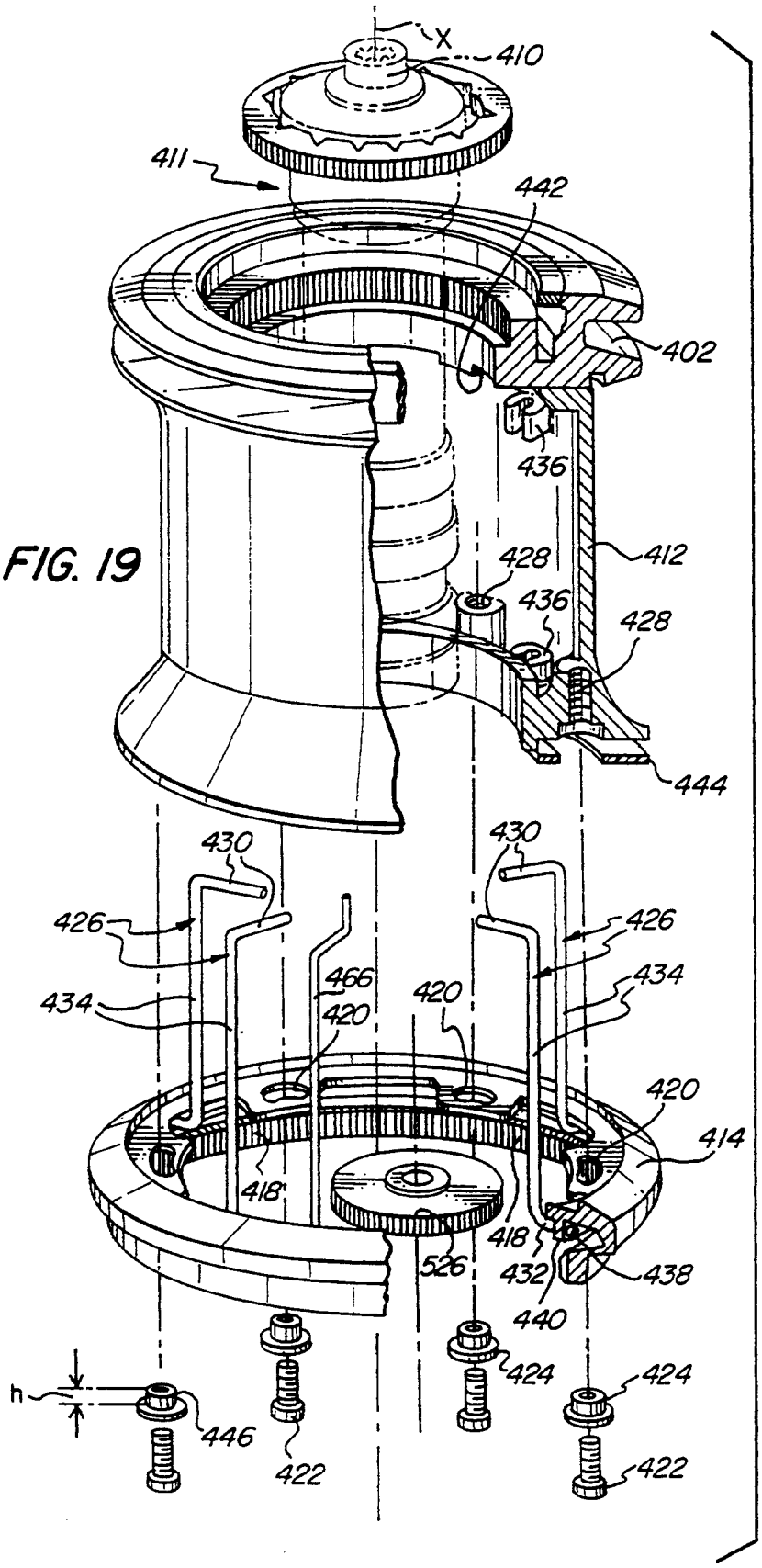
FIG. 19 is a partially cut away, exploded isometric view illustrating assembly of the winch drum portions of the winch of FIG. 17.

Referring also to FIGS. 18 and 19, load receiving drum portion 412 bears a variable torque load applied by a line, rope, chain or the like 416. Second drum portion 414 includes a ring gear 418 and a plurality of guide slots 420. Drum portions 412, 414 are mounted together by a plurality of nuts 422 and slot following washers 424. Nuts 422 and washers 424 are inserted into slots 420, and nuts 422 are further inserted into threaded holes 428 in load receiving drum portion 412.

Winch drum portions 412, 414 are preferably mounted together with a washer 444 of DELRIN or the like in between to permit relative rotation of winch drum portions 412, 414 without causing undue friction or wear. In order to permit relative rotation of drum portions 412, 414, following washers 424 include a slot following portion 446 having a height h slightly greater than a total thickness of slot 420 and DELRIN washer 444 so that bolts 422 may be snugged without clamping the drum portions together.

Winch drum 408 includes a plurality of torsion bars 426 which transmit load and drive torque between winch drum portions 412, 414. Torsion bars 426 operate in two planes represented by upper arms 430 and lower arms 432 which are spaced apart by an axial twist portion 434. The plane of upper arms 430 lies substantially within load receiving drum portion 412, and the plane of lower arms 432 lies substantially within second drum portion 414. Twist portions 434 of torsion bars 426 are mounted to inner surface 435 of load receiving drum portion 412 by brackets 436. Ends 438 of lower arms 432 are substantially held in place in second drum portion 414 within sleeves 440. Upper arms 430 are received against shoulders 442 formed on the underside 443 of load receiving drum portion 412.

Figure 20:
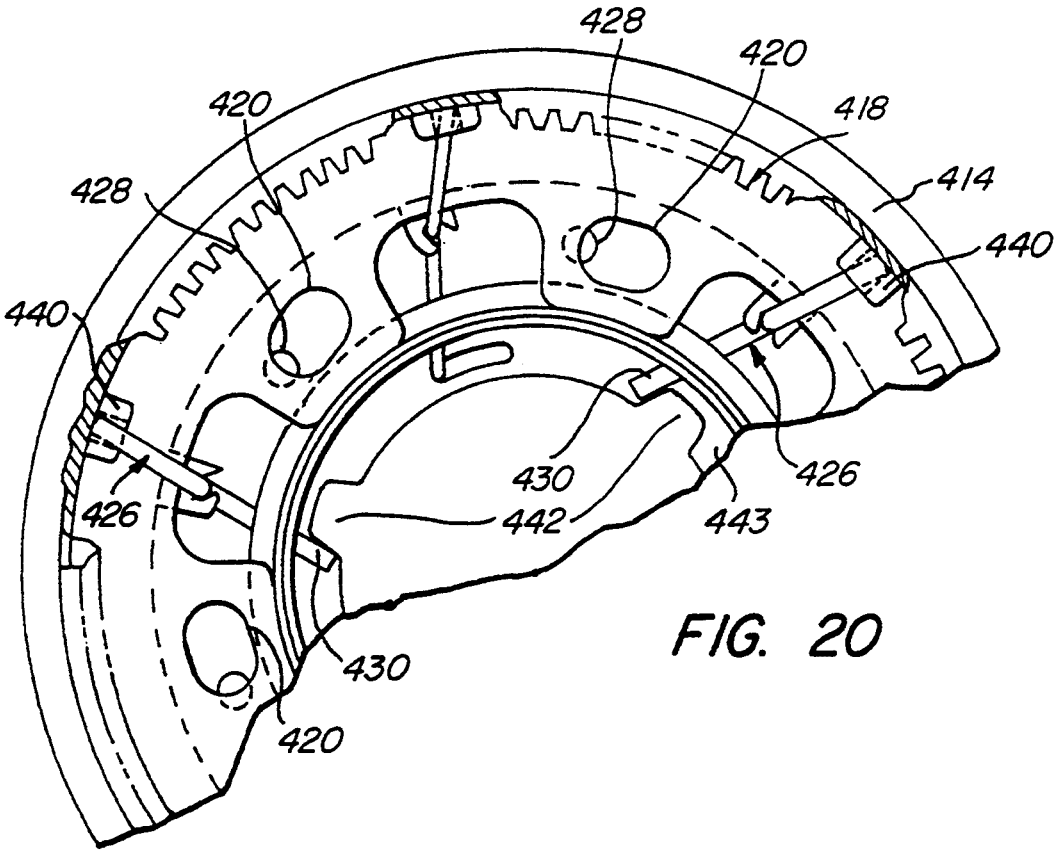
FIGS. 20–22 are partial bottom plan views of the winch of FIG. 17 prior to assembly and in the first and second rotatinal positions of the winch drum portions.
Figure 21:
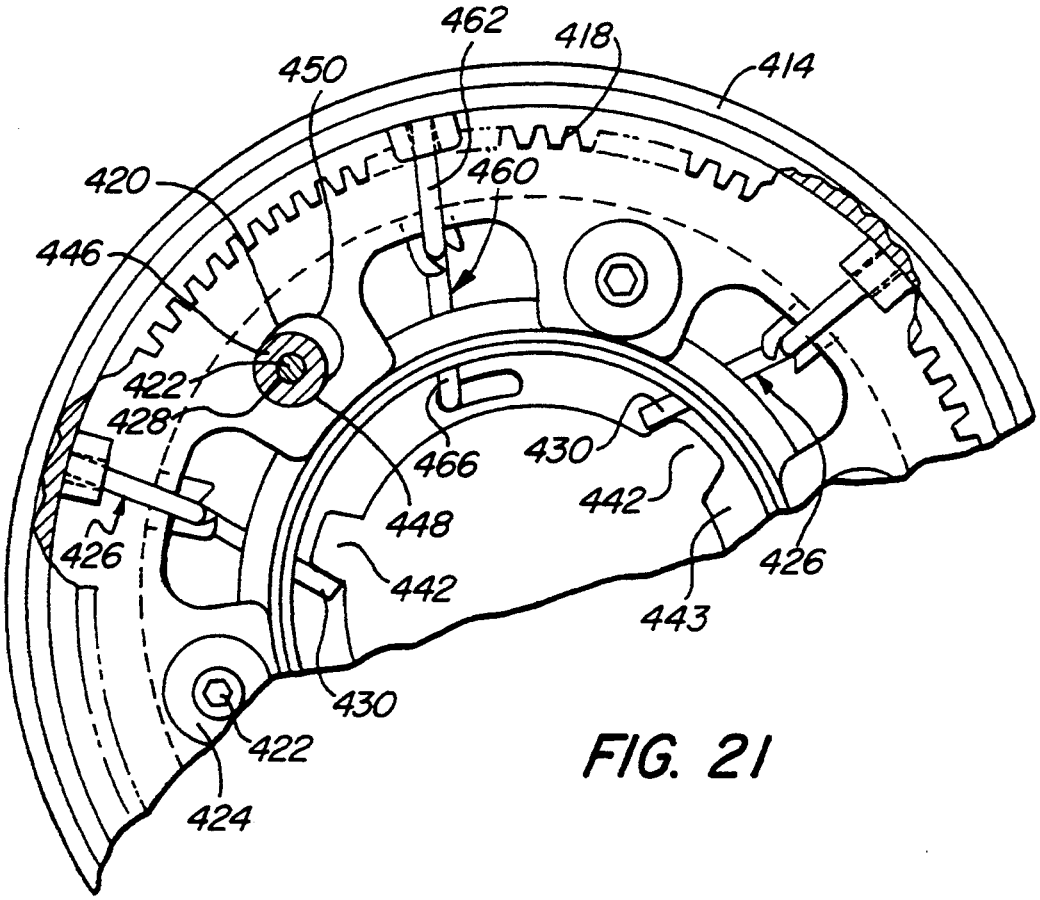
Figure 22:
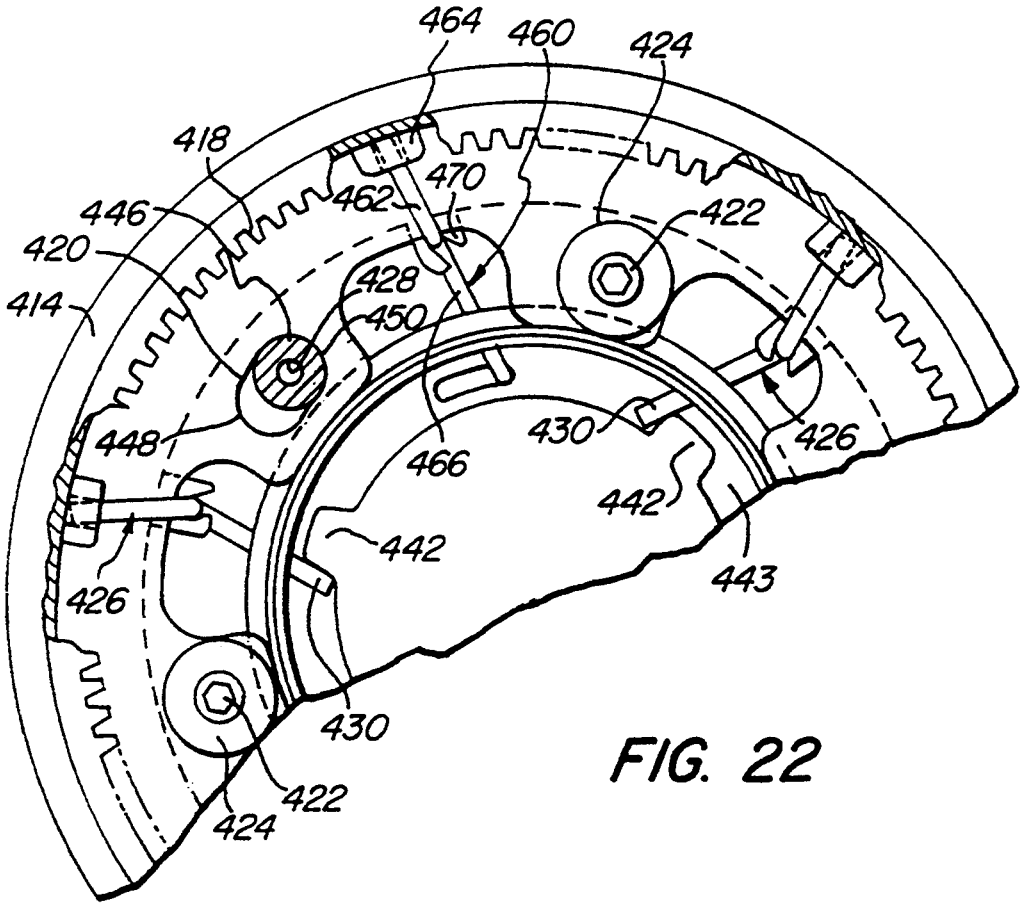

Referring now to FIGS. 18–22, and especially 20–22, assembly of winch drum 408 is illustrated. FIGS. 20–22 are bottom views with base 406, main drive assembly 411 and all gears removed. In FIG. 20, drum portions 412, 414, washer 444, and torsion bars 426 have been assembled together with no torsion load on the torsion bars. As illustrated, threaded holes 428 in load receiving drum portion 412 are not aligned with slots 420 in second drum portion 414. In order to align holes 428 with slots 420, a small amount of preload is placed upon torsion bars 426 by rotating second drum portion 414 a small amount with respect to load receiving drum portion 412 (counterclockwise viewing winch 400 from the bottom as in FIGS. 20–22), twisting twist portions 434 of torsion bars 426.

As illustrated by comparing FIGS. 20 and 21, preloading or twisting torsion bars 426 a relatively small amount permits following portions 446 of following washers 424 to be received within slots 420 and permits nuts 422 to be received within threaded holes 428 to mount drum portions 412, 414 together. As illustrated in FIG. 21, preload on torsion bars 426 biases following portions 446 to a first end 448 of slots 420 representing a first rotational position of drum portions 412, 414 with respect to each other.

Now comparing FIGS. 21 and 22, second drum portion 414 may be rotated with respect to load receiving drum portion 412 (counterclockwise as viewed from the bottom of winch 400), further against the bias in torsion bars 426. In this regard, following portions 446 of washers 424 are guided along slots 420 to second ends 450 thereof representing a second rotational position of drum portions 412, 414 with respect to each other.

In FIGS. 20–22, the amount of torsion or twist on torsion bars 426 is represented by the angle between upper and lower arms 430, 452. In FIG. 20, arms 430, 432 lie in a substantially straight line through twist axis 434 which represents no torsion on bars 426. In FIGS. 21 and 22, however, arms 430, 432 are brought progressively closer together as twist portions 434 are twisted further and further to increase the torsion bias on the bars. Further, the amount of relative rotation of winch drum portions 412, 414 is determined by the number of degrees through which the following portions 446 of washers 424 move from first ends 448 to second ends 450 of slots 420.

Referring now to FIGS. 18, 21 and 22, relative rotation of winch drum portions 412, 414 from the first rotational position (FIG. 21) to the second rotational position (FIG. 22) actuates a lever 460 which, similar to torsion bars 426, operates in two planes, one plane substantially located in each of the drum portions 412, 414. Lever 460 comprises a lower arm 462 substantially retained in a sleeve 464 within second drum portion 414, an upper arm 466, and an axially extended pivot portion 468 rotatably mounted by brackets 470 within load receiving drum portion 412. Lever 460 is coupled to angularly displace a ring 480 from a first angular position (see FIGS. 18 and 23) to a second angular position (see FIGS. 18 and 24) as the drum portions rotate from the first to the second rotational positions. Movement of following portions 446 of washers 424 back and forth in slots 420 results in back and forth movement of lever upper arm 466 which causes back and forth angular displacement of ring 480. Lever 460 includes a second axial portion 482 connected to upper arm 466 which engages a tab 484 connected to ring 480.

Figure 23:
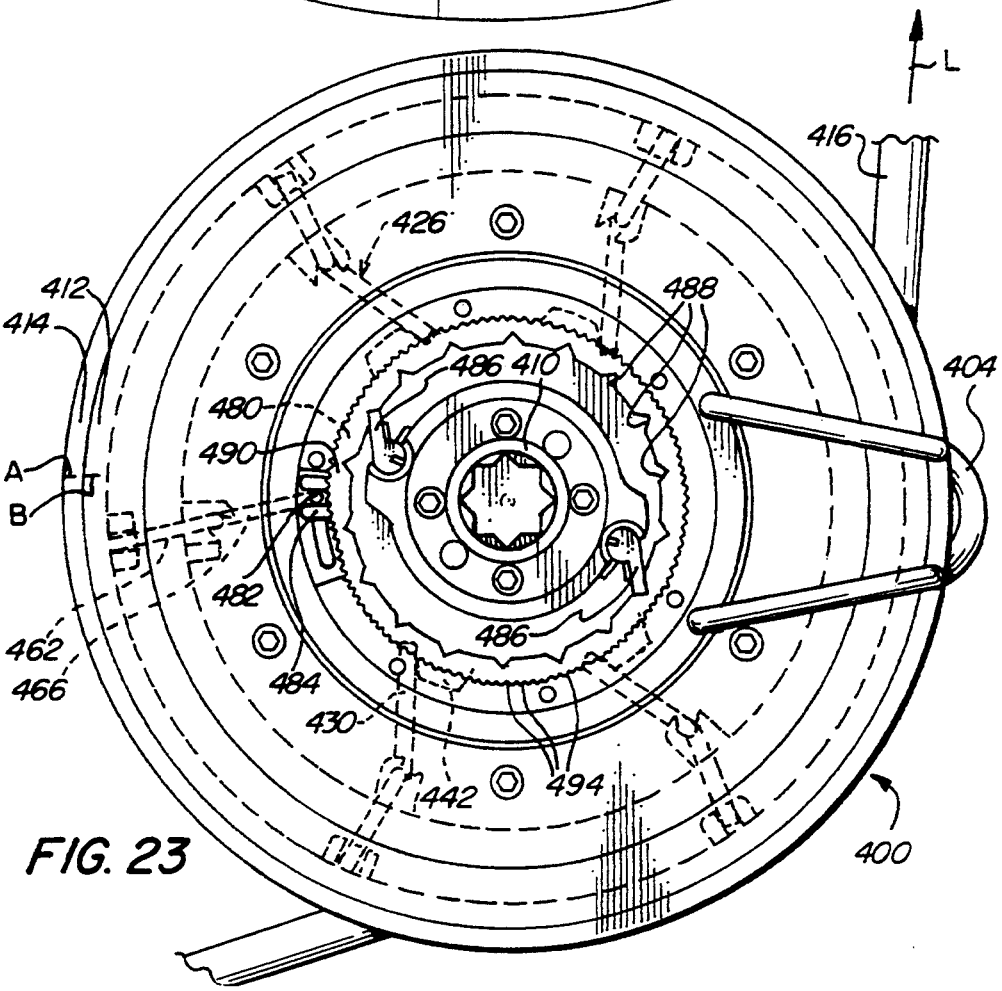
FIGS. 23 and 25 are enlarged partial top plan views illustrating the drive positions of the isolation ring of the winch of FIG. 17.
Figure 24:
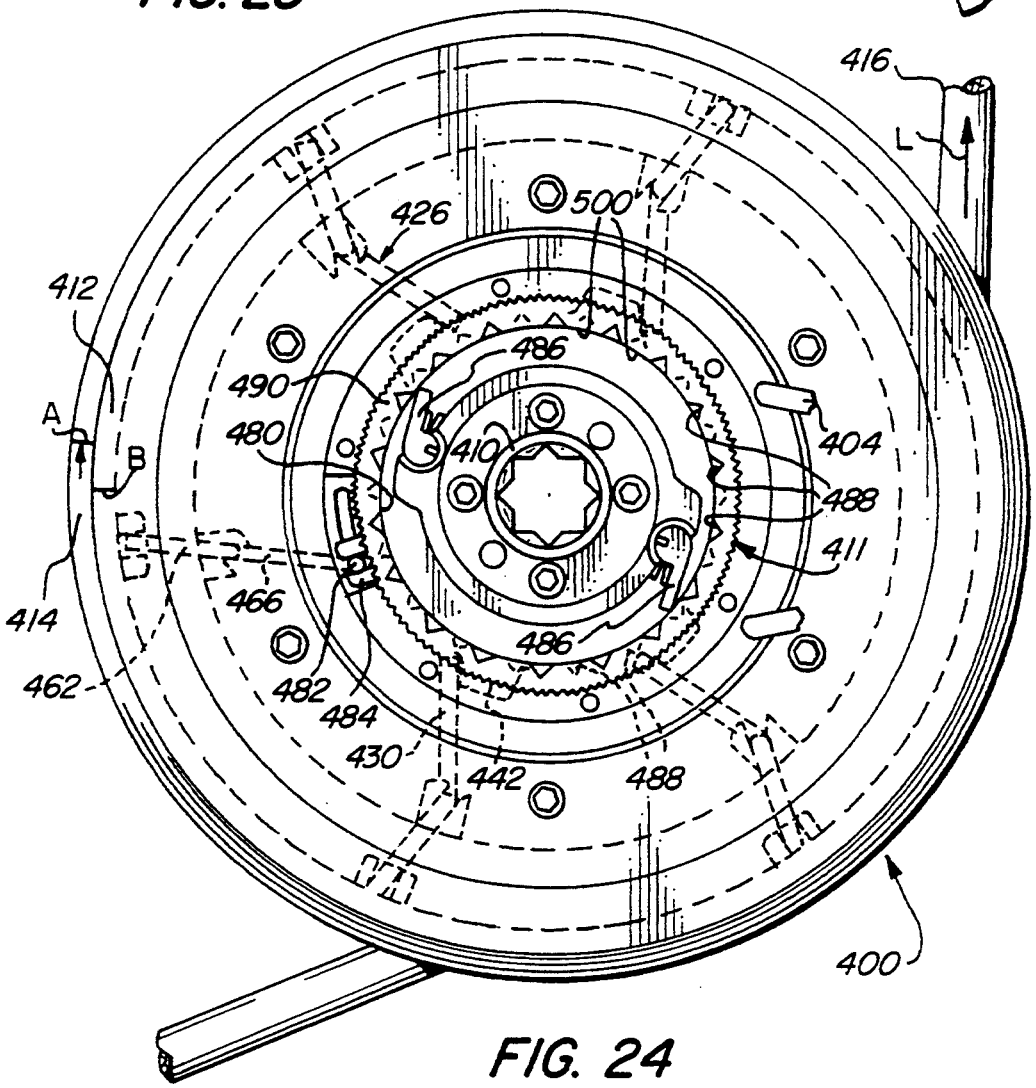

FIGS. 23 and 24 are top plan views of winch 400. FIG. 23 corresponds to the bottom view of FIG. 21, showing winch drum portions 412, 414 in the first rotational position with a slight preload twist on torsion bars 426. Similarly, FIG. 24 corresponds to the bottom view of FIG. 22, showing winch drum portions 412, 414 in the second rotational position illustrated by the offset between reference marks A and B (marks A and B are aligned in the first rotational position of FIG. 23). In the second rotational position, torsion bars 426 are further twisted to provide additional bias for returning the winch drum portions to the first rotational position.

As indicated by the illustrated position of tab 484, ring 480 is angularly displaced between a first angular position (FIG. 23) when drum portions 412, 414 are in the first rotational position to a second angular position (FIG. 24) when drum portions 412, 414 are in the second rotational position.

Figure 25:
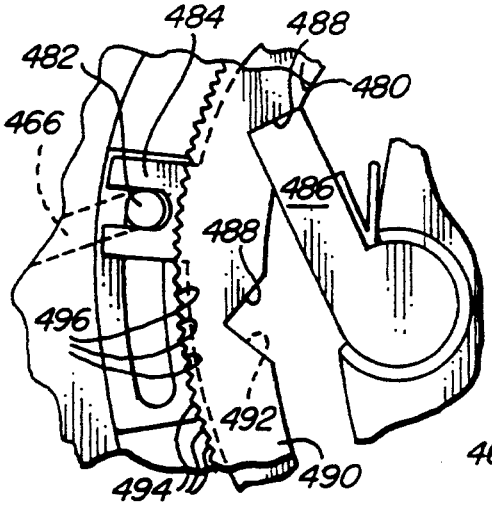
Figure 27:
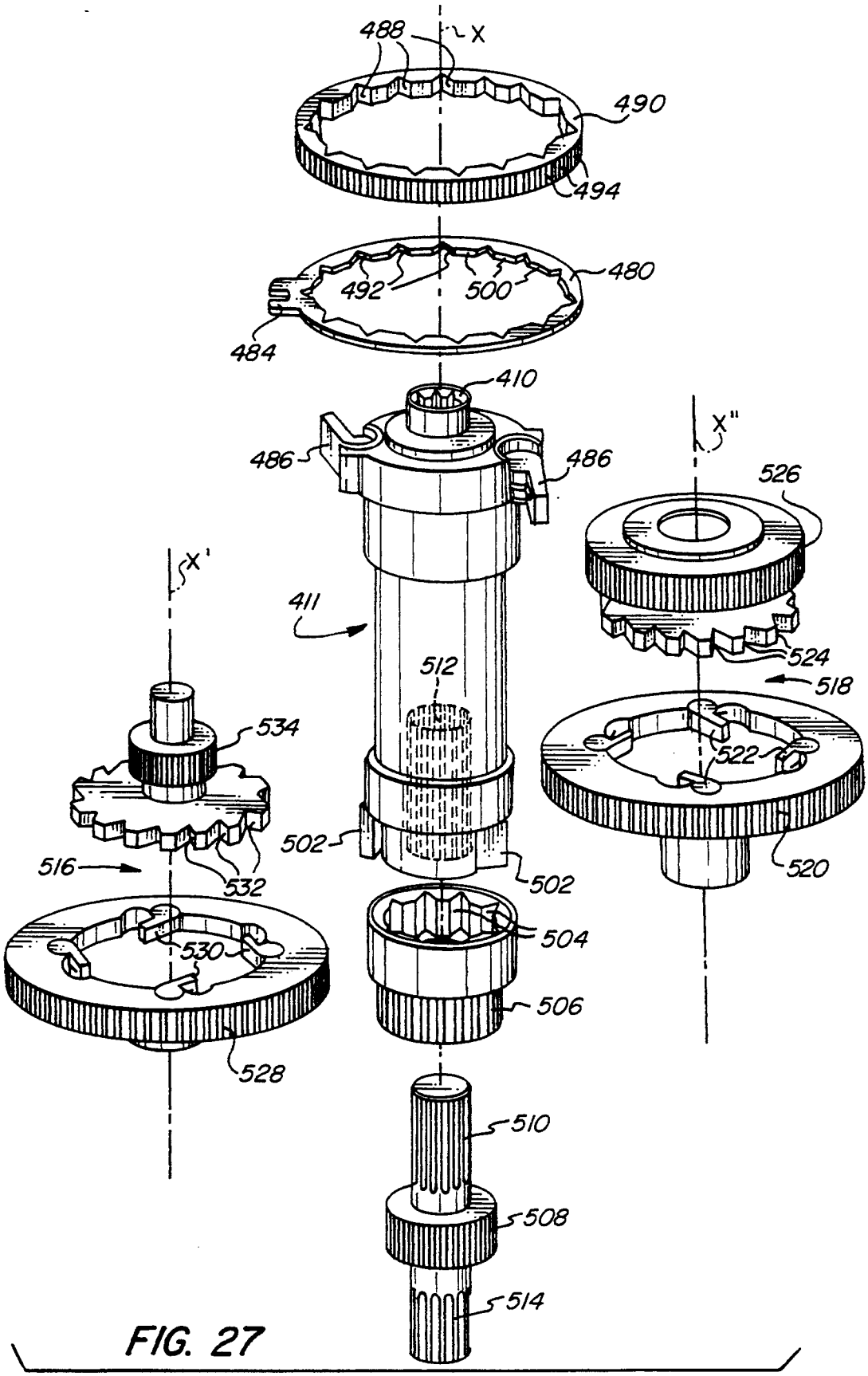
FIG. 27 is an exploded isometric view of the drive components of the winch of FIG. 17.

Referring to FIGS. 23, 25 and 27, in the first angular position of ring 480, pawls 486 mounted for rotation by drive shaft 410 engage teeth 488 to drive ratchet gear 490 clockwise when drive shaft 410 is rotated clockwise as viewed from above. Pawls 486 also engage teeth 492 of ring 480. Pawls 486 are preferably radially outwardly biased from drive shaft 410, and are preferably mounted together with drive shaft 410 as part of main drive assembly 411. When drive shaft 410 is rotated counterclockwise as viewed from above, pawls 486 click along teeth 488, 492 but do not drive ratchet gear 490.

Ratchet gear 490 includes outer teeth 494 which mesh with drive teeth 496 on load receiving drum portion 412 (see FIG. 25). Thus, clockwise rotation of ratchet gear 490 directly drives load receiving drum portion 412 clockwise which drives second drum portion 414 clockwise via bolts 422 and following washers 424. With ring 480 in the first angular position, drum portions 412, 414 are in the first rotational position, and following portions 446 of the washers lie at first ends 448 of slots 420 (see FIG. 21).

Figure 26:
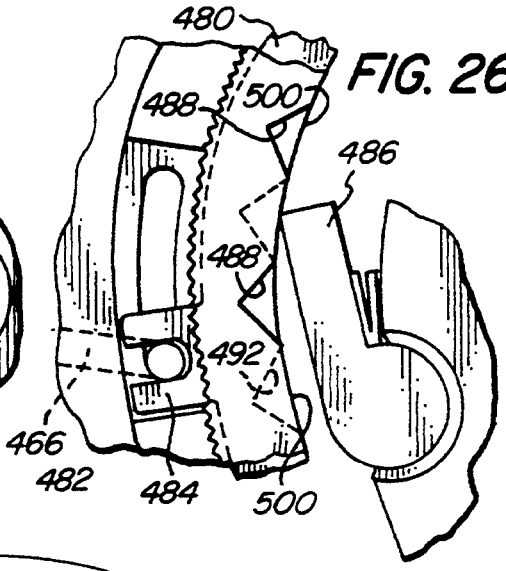
FIGS. 24 and 26 are enlarged partial top plan views illustrating the drive and block out positions of the isolation ring of the winch of FIG. 17.

Referring now to FIGS. 24, 26 and 27, in the second angular position of ring 480, ratchet gear 490 is isolated and not permitted to be driven by pawls 486 when drive shaft 410 is rotated clockwise as viewed from above. In addition to teeth 492 for engagement by pawl 486, ring 480 also includes teeth 500 for blocking ratchet gear teeth 488 from engagement by pawl 486. When ring 480 is angularly displaced by lever 460 to the second angular position (drum portions 412, 414 are in the second rotational position, blocking teeth 500 close ratchet gear teeth 488 on ratchet gear 490, preventing winch drum 408 from being driven by ratchet gear 490.

Turning now to FIGS. 18 and 27, the internal gearing of three speed winch 400 is illustrated. In FIG. 18, gears are shown in their actual positions; in FIG. 27, the gears are depicted in an exploded view for clarity. Main shaft assembly 411 fits into an internal housing (not shown in any Figure) which substantially encloses the internal gearing. It is understood that winch drum 408 and main shaft assembly 411 are mounted to the internal housing with appropriate bushings, bearings and the like (also not shown in any Figure).

In addition to pawls 486, main shaft assembly 411 also includes pawls 502 biased radially outwardly from drive shaft 410 for engaging teeth 504 to drive second speed input ratchet gear 506 when drive shaft 410 is rotated counterclockwise as viewed from above. Thus, when drive shaft 410 is cranked clockwise from above, pawls 486 drive direct drive gear 490 via teeth 488 while pawls 502 click across teeth 504 without driving second speed input gear 506. Conversely, when drive shaft 410 is cranked counterclockwise from above, pawls 502 drive second speed input gear 506 via teeth 504 while pawls 486 click or slide across teeth 488 without driving direct drive gear 490.

Main shaft assembly 411 also includes a third speed input pinion 508 mounted beneath a splined shaft 510 for receipt within an axially ridged cylindrical opening 512 in drive shaft 410 for clockwise and counterclockwise rotation with the drive shaft. A splined shaft portion 514 may extend below third speed input pin 508 for use to connect an alternate means to rotate drive shaft 410. All components of main shaft assembly 411 are aligned about axis X.

In addition to main shaft assembly 411, winch 400 also includes a third speed shaft assembly 516 and a final drive shaft assembly 518.

Third speed and final drive shaft assemblies 516, 518 are respectively aligned along axes X' and X" substantially parallel to axis X.

Final drive shaft assembly 518 includes a final drive pawl gear 520 mounted in a meshing relationship with second speed input gear 506. Final pawl gear 520 includes internal pawls 522 for engaging teeth 524 of final drive ratchet gear 526. Pawls 522 are arranged to drive final ratchet gear 526 clockwise as viewed from above when final drive pawl gear 520 is driven clockwise by second speed input gear 506 (which is driven counterclockwise by drive shaft 410).

Final ratchet gear 526 is mounted in a meshing relationship with ring gear 418 of second drum portion 414 (see FIG. 19). Clockwise rotation of final ratchet gear 526 rotates second drum portion 414 clockwise and, via torsion bars 426, or bolts 422 and washers 424, rotates load receiving drum portion 412 clockwise.

Third speed shaft assembly 516 includes a third speed pawl gear 528 mounted in a meshing relationship with third speed input pinion 508. Third speed pawl gear 528 includes internal pawls 530 for engaging teeth 532 of third speed ratchet gear 534. Pawls 530 are arranged to drive third speed ratchet gear 534 counterclockwise as viewed from above when third speed pawl gear 528 is driven counterclockwise by third speed input gear 508 (which is driven clockwise by drive shaft 410).

Third speed ratchet gear 534 is mounted in a meshing relationship to drive final pawl gear 520 when second speed input gear 506 does not, i.e., when drive shaft 410 is rotated clockwise as viewed from above.

Figure 28:
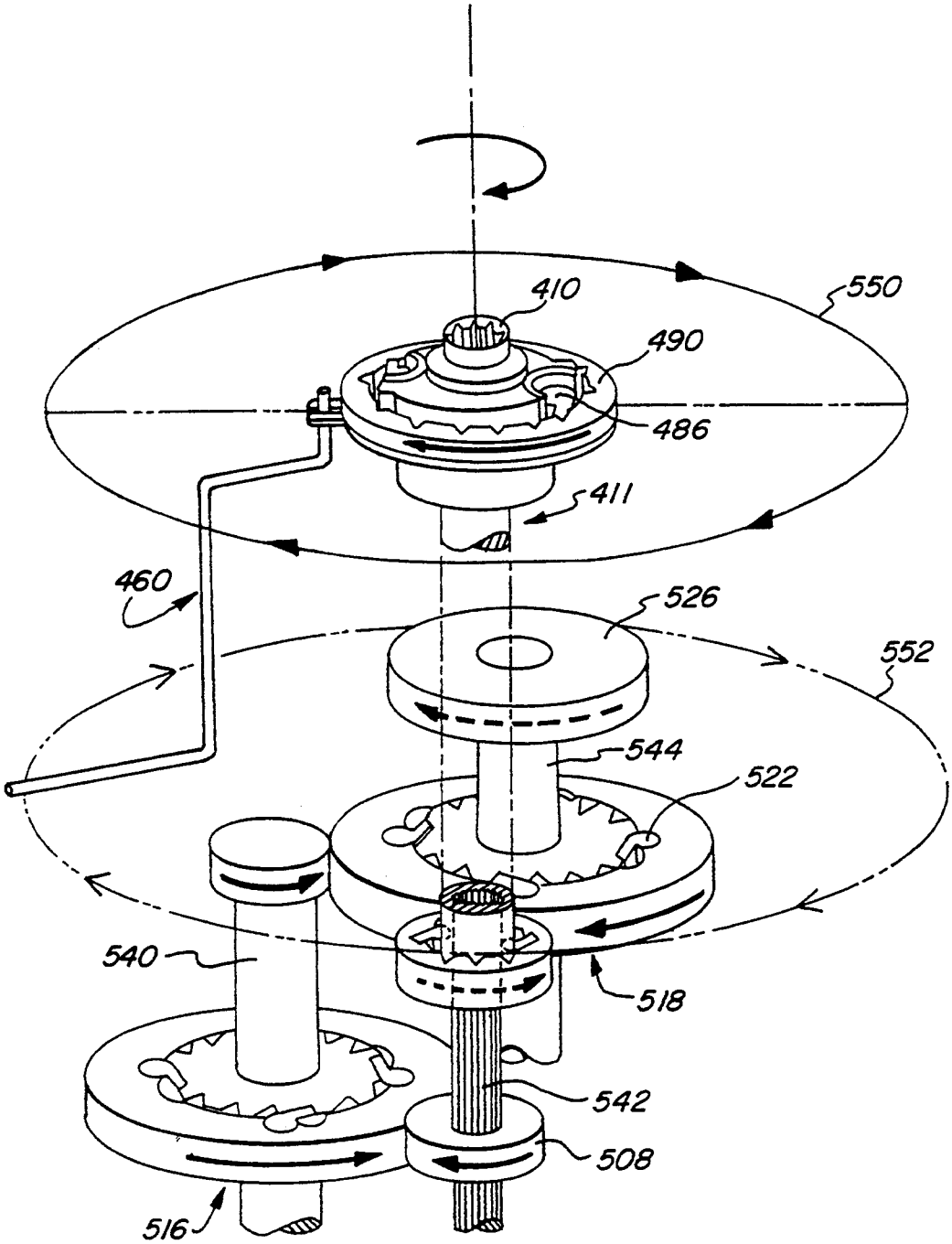
FIGS. 28–30 are schematic isometric views of the drive components of the winch of FIG. 17 which illustrate how the winch drum is driven in each of three different speeds for constant rotational speed of the drive shaft.
Figure 29:
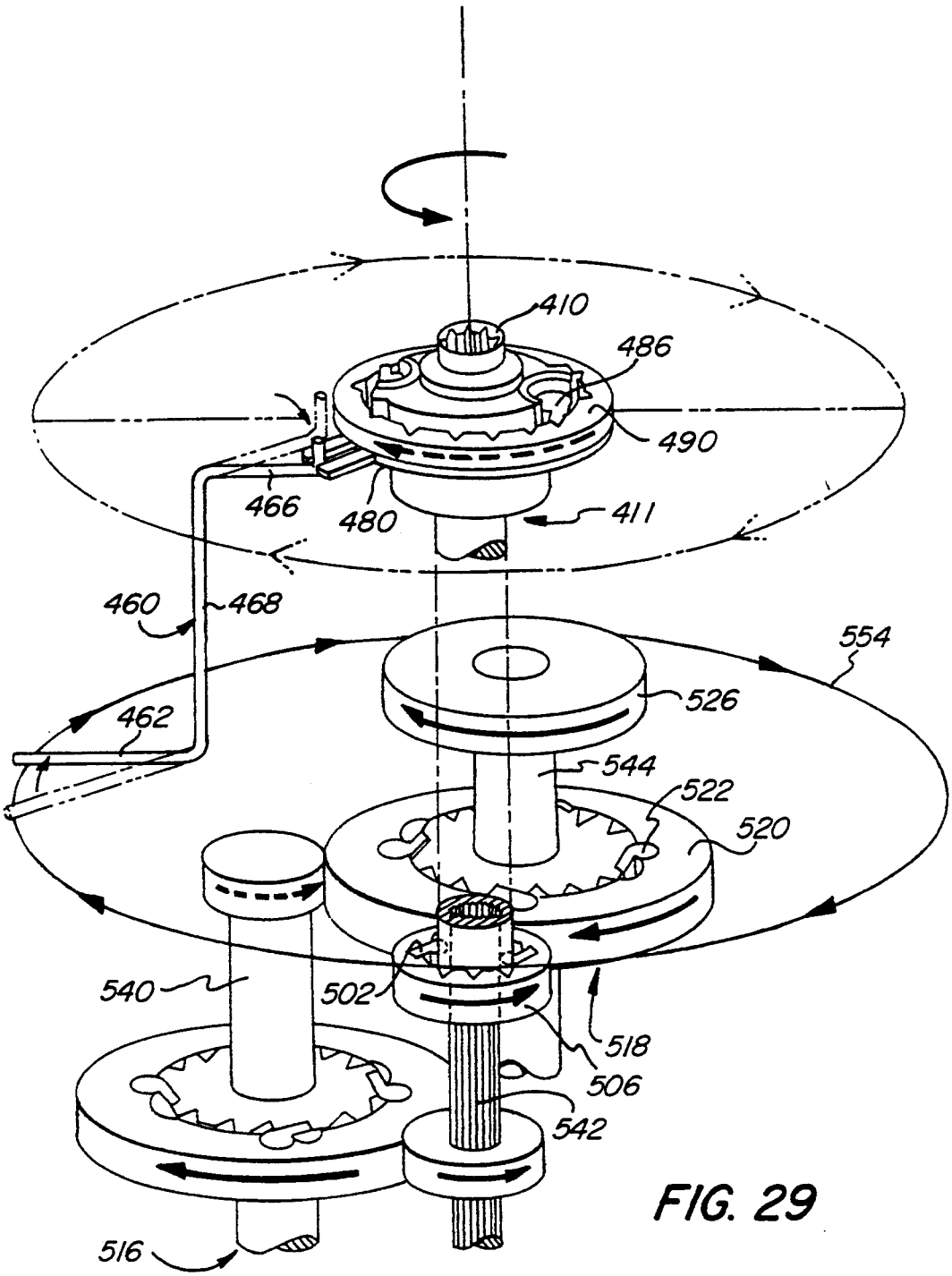
Figure 30:
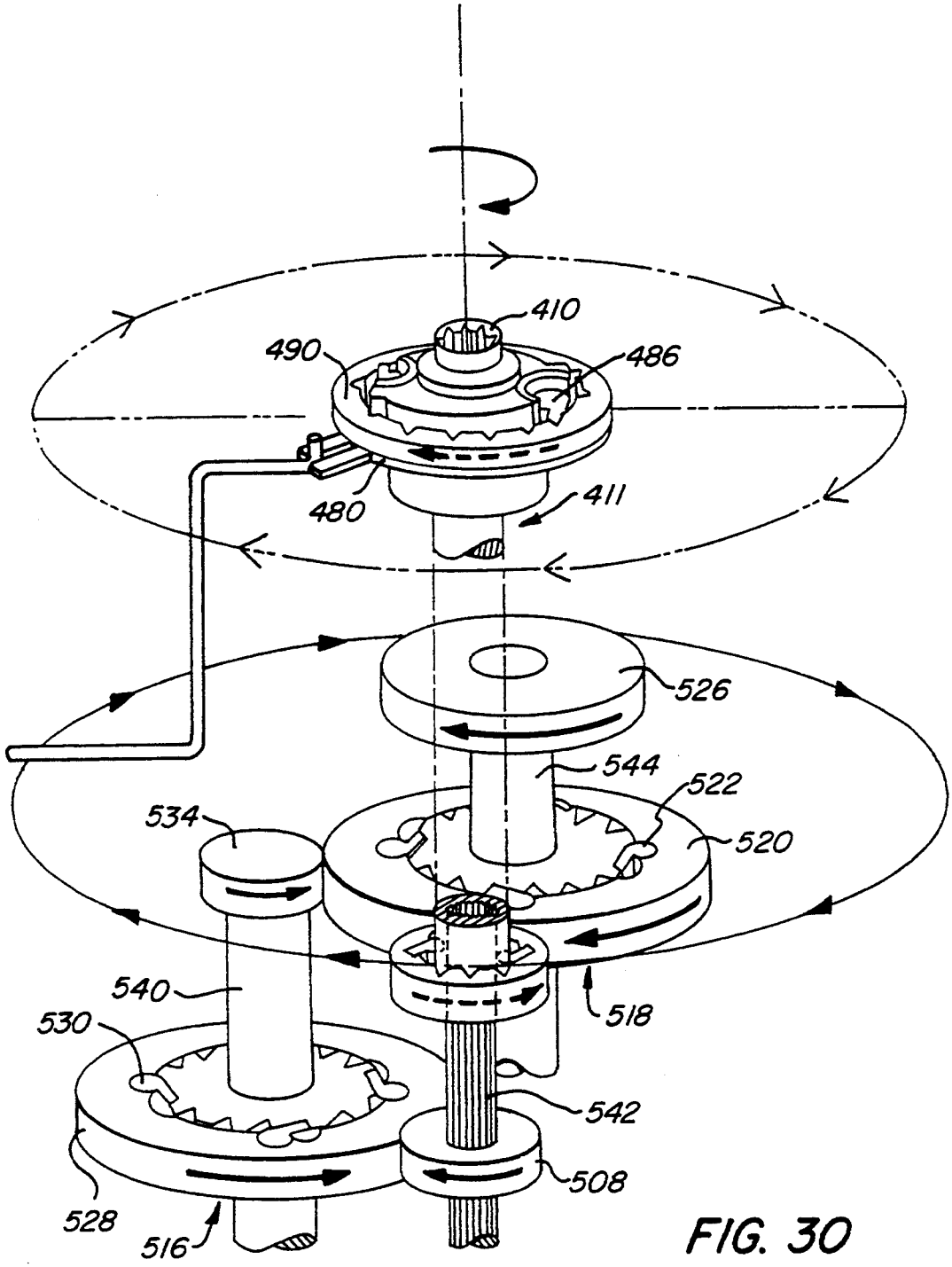

Operation of winch 400 in each of its three different speeds will now be described with reference to FIGS. 18, 23–24 and 27–30. FIGS. 28–30 are schematic representations of the gearing of winch 400 which have artificially extended shaft portions 540, 542 and 544 in order to more clearly depict meshing and operation of the various pinions at each of the three winch speeds. It is understood that by "three different speeds" is meant that winch drum 408 is by means of the internal gearing of winch 400 rotatable at three different speeds or with three different degrees of mechanical advantage for a constant speed and force applied to rotate drive shaft 410.

Winch drum 408 is designed to rotate clockwise and thus to oppose loads (indicated at L on line 416 in FIGS. 23–24) tending to rotate winch drum 408 counter clockwise as viewed from above. It is understood that winch 400 could readily be designed to rotate in the opposite direction.

FIGS. 23 and 28 represent the first or direct drive speed of winch 400. First speed provides the fastest rotation of winch drum 408 and the lowest mechanical advantage to oppose load L. Thus, first speed is best suited for relatively small loads. With reference to FIG. 23, first speed is achieved with ring 480 in the first angular position, i.e., with winch drum portions 412, 414 in the first rotational position, by cranking drive shaft 410 clockwise to drive first speed or direct drive ratchet gear 490. Direct ratchet gear 490 drives load receiving portion 412 of winch 408 as indicated by solid line 550.

Clockwise rotation of second winch portion 414 indicated by dashed line 552 rotates final ratchet gear 526, however, the relatively high speed of winch drum 408 and thus of final ratchet gear 526 causes ratchet teeth 524 to overrun pawls 522 which are trying, via third speed input gear 508, to drive final ratchet gear 526 at a relatively lower speed. Gears with solid arrows are being driven by shaft 410 in the direction indicated, while gears with dashed lines are overrunning or not engaged by their respective pawls. In this regard, it is understood that pawls 522 are not strictly necessary to proper functioning of winch 400.

FIGS. 23, 24 and 29 represent the second speed of winch 400 which provides an intermediate rotational speed of winch drum 408 and an intermediate mechanical advantage to oppose load L. With reference to FIGS. 23–24, ring 480 may be in its first or its second angular position during operation of winch 400 in second speed. Similarly, winch drum portions 412, 414 may be in the first or second relative rotational positions during operation of winch 400 in second speed. Returning to FIG. 29, second speed is achieved by cranking drive shaft 410 counterclockwise which causes pawls 502 to drive second speed input gear 506 counterclockwise, which drives final pawl gear 520 and, via pawls 522, final ratchet gear 526 clockwise to drive second winch drum portion 414 clockwise via ring gear 418 (see FIG. 18) as indicated by solid line 554.

When drive shaft 410 is cranked counterclockwise, pawls 486 either click over ratchet teeth 488 of direct ratchet gear 490 (if ring 480 is in the first angular position of FIG. 23) or slides over blocking teeth 500 of ring 480 (if ring 480 is in the second angular position of FIG. 24).

Now also referring to FIGS. 21 and 22, movement of winch drum portions 412, 414 from the first to the second rotational position and consequent displacement of ring 480 from the first to the second angular position can be further described. In the second speed of winch 400, second winch drum portion 414 including slots 420 is driven clockwise as viewed from the top. This clockwise drive force is transmitted, at least initially, by torsion bars 426 to load receiving drum portion 412 for opposing load L. However, as load L approaches the bias resisting relative rotation of winch drum portions 412, 414 toward the second rotational position, torsion bars 426 will stop transmitting drive force to oppose load L and will begin twisting, permitting second drum portion 414 to rotate counterclockwise as viewed from above with respect to load receiving drum portion 412 (clockwise as viewed from below as in FIGS. 21–22). The twist or bias of torsion bars 426 will increase until following portions 446 of washers have moved along slots 420 to second ends 450 (FIG. 22). At this point drive force is transmitted by nuts 422 and washers 424 to load receiving drum portion 412 for again opposing load L. This relative rotation of second drum portion 414 is sensed by lower arm 462 of lever 40 and is transmitted via pivot portion 468 to upper arm 466 for angularly displacing ring 480 from the first to the second angular position. Thus, load on the winch during operation in the second speed determines the position of ring 480 and whether further clockwise rotation of drive shaft 410 will provide the first speed or the third speed of winch 400.

Winch drum portions 412, 414 remain in the second rotational position so long as load L is greater than the return bias on torsion bars 426 since winch drum 408 only rotates clockwise as viewed from above. It is understood that springs or other biasing means could be used to replace torsion bars 426. It is further understood that the magnitude of the biasing force will determine the load at which the isolation of one gear in favor of another is accomplished, and that preload on the biasing means determines the load at which isolation of the one gear is commenced.

FIGS. 24 and 30 represent the third speed of winch 400. The third speed provides the lowest winch drum speed and the greatest mechanical advantage for opposing load L. To obtain the third speed, winch 400 must previously have been driven in second speed for evaluation of load L as compared with the bias or torsion bars 426 to determine the angular position of ring 480. Assuming load L exceeded the torsion bar bias in second speed, third speed is obtained by again rotating drive shaft 410 clockwise as viewed from above. Unlike first speed, blocking teeth 500 of ring 480 prevent pawls 486 from driving direct ratchet gear 490. Direct ratchet gear 490 is isolated and prevented from driving winch drum 408 by ring 480. In third speed, third speed input pin 508 is rotated clockwise by drive shaft 410 and rotates third pawl gear 528 counterclockwise which via pawls 530 rotates third speed ratchet gear 534 counterclockwise. Third speed ratchet gear 534 rotates final pawl gear 520 clockwise and, as explained above for second speed, second winch drum portion 414 is rotated. In third speed, rotation of second drum portion 414 is transmitted through bolts 422 and washers 424 to load receiving drum portion 412 to oppose load L.

In summary, it should be understood that a winch in accordance with the present invention has a torque load sensing capability that enables the winch to shift to the appropriate gear speed in response to variations in torque load. This is done in a particularly simple manner without parts that wear to a significant degree.

It should be understood that although specific embodiments of the invention have been described herein in detail, such description is for purposes of illustration only and modifications may be made thereto by those skilled in the art within the scope of the invention.

What is claimed is:

1. A load-responsive automatic-shifting winch comprising:

a base;

a winch drum rotatably mounted on said base;

a rotatable drive shaft for driving said winch drum;

at least two gear trains, each including at least one gear and mounted between said drive shaft and said winch drum for rotating said winch drum in response to rotation of said drive shaft, one of said two gear trains producing a different winch drum speed than the other of said gear trains for the same rotational speed of said drive shaft; and a mechanism displaceable between first and second positions in response to changes in load on said winch drum, said mechanism including means for engaging one of said gear trains at the first position and for disengaging said one gear train at the second position to isolate said one gear train and provide for rotation of said winch drum by the other of said gear trains, said winch drum having a load receiving portion, a second portion, and means for mounting said load receiving and second winch drum portions together, said mounting means permitting said load receiving and second winch drum portions to rotate with respect to each other from a first rotational position to a second rotational position and including means responsive to rotation from the first to the second rotational positions for displacing said mechanism between the first and second positions.

2. The winch according to claim 1 wherein said mechanism is angularly displaceable in response to changes in load on said winch drum, said mechanism including means for engaging one of said gear trains at a first angular position of said mechanism and for disengaging said one gear train at a second angular position to isolate the one gear train and permit said drum to be rotated by the other of said gear trains.

3. The winch according to claim 1 wherein said gear of said one gear train is mounted between said drive shaft and said load receiving drum portion, said gear of said other gear train is mounted between said drive shaft and said second drum portion, and said mounting means transmits torque applied to said drive shaft between said load receiving and second drum portions.

4. The winch according to claim 1 wherein said mounting means provides a bias opposing rotation of said load receiving and second drum portions toward the second rotational position, and said winch further comprising means for retaining said load receiving and second drum portions in the second rotational position while the load on said load receiving drum portion remains large enough to overcome the bias.

5. A load-responsive automatic-shifting winch comprising:

a base;

a winch drum rotatably mounted on said base;

a rotatable drive shaft for driving said winch drum;

at least two gear trains, each including at least one gear and mounted between said drive shaft and said winch drum for rotating said winch drum in response to rotation of said drive shaft, one of said two gear trains producing a different winch drum speed than the other of said gear trains for the same rotational speed of said drive shaft; and a mechanism angularly displaceable in response to changes in load on said winch drum, said mechanism including means for engaging one of said gear trains at a first angular position of said mechanism and for disengaging said one gear train at a second angular position to isolate the one gear train and permit said drum to be rotated by the other of said gear trains, said winch drum having a load receiving portion, a second portion, and means for mounting said load receiving and second winch drum portions together, said mounting means permitting said load receiving and second winch drum portions to rotate with respect to each other from a first rotational position to a second rotational position and including means responsive to the rotation from the first to the second rotational positions for displacing said mechanism between the first and second angular positions.

6. The winch according to claim 5 wherein said gear of said one gear train is mounted between said drive shaft and said load receiving drum portion, said gear of said other gear train is mounted between said drive shaft and said second drum portion, and said mounting means transmits torque applied to said drive shaft between said load receiving and second drum portions.

7. The winch according to claim 5 wherein said mounting means provides a bias opposing rotation of said load receiving and second drum portions toward the second rotational position, and said winch further comprising means for retaining said load receiving and second drum portions in the second rotational position while the load on said load receiving drum portion remains large enough to overcome the bias.

8. The winch according to claim 5 wherein said mechanism comprises a pawl mounted for rotation by said drive shaft, said pawl engaging ratchet teeth on said gear of said one gear train to drive said winch drum.

9. The winch according to claim 8 wherein said mechanism further comprises an angularly displaceable ring permitting engagement of said gear ratchet teeth by said pawl at the first angular position and blocking said gear ratchet teeth to prevent engagement by said pawl in the second angular position.

10. The winch according to claim 9 wherein said winch drum comprises a load receiving portion, a second portion, and means for mounting said load receiving and second winch drum portions together, said mounting means permitting said load receiving and second winch drum portions to rotate a relatively small amount with respect to each other and including means responsive to the relatively small rotation for displacing said mechanism between the first and second angular positions, said ring including a tab for coupling with said displacing means.

11. The winch according to claim 10 wherein said displacing means angularly displaces said ring in a first direction as said second drum portion rotates in a second direction with respect to said load receiving drum portions, the second direction substantially opposite to the first direction.

12. The winch according to claim 10 wherein said displacing means comprises a lever operating along a pivot axis in two planes, one of the planes located in the second winch drum portion and the other plane located in the load receiving winch drum portion and coupled to said ring tab.

13. The winch according to claim 9 wherein said ring comprises a plurality of teeth for engagement by said pawl.

14. The winch according to claim 9 wherein said ring comprises a plurality of teeth for blocking said pawl engaging ratchet teeth on said one gear.

15. The winch according to claim 9 wherein said ring is mounted within said winch drum in axial alignment with said drive shaft.

16. The winch according to claim 8 wherein said gear is mounted within said winch drum in axial alignment with said drive shaft.

17. The winch according to claim 5 wherein said mounting means comprises slots in one of said winch drum portions and followers in the other of said winch drum portions, the followers for sliding along the slots to guide and limit the extent of relative rotation of said winch drum portions.

18. The winch according to claim 17 wherein said mounting means further comprises means for biasing said winch drum portions in the first rotational position to set the amount of load on the winch necessary to begin angular displacement of said mechanism, a first end of said slots retaining said winch drum portions in the biased first rotational position in the absence of the necessary load on the winch.

19. The winch according to claim 18 wherein said biasing means comprises torsion bars.

* * * * *

UNITED STATES PATENT AND TRADEMARK OFFICE

CERTIFICATE OF CORRECTION

PATENT NO. : 5,368,279
DATED : November 29, 1994
INVENTOR(S) : William Ottemann, Bruno Resch and Guillermo Ferramola It is certified that error appears in the above-indentified patent and that said Letters Patent is hereby corrected as shown below:

On the title page, insert the following data:

Related U.S. Application Data [63] Coninuation-in-part of

Ser. No. 01/101,804, March 21, 1991.

Signed and Sealed this

Thirteenth Day of August, 1996

*Attest:*

Bruce Lehman

BRUCE LEHMAN

*Attesting Officer*

*Commissioner of Patents and Trademarks*